US011155988B1

(12) United States Patent
Ogorchock et al.

(10) Patent No.: US 11,155,988 B1
(45) Date of Patent: Oct. 26, 2021

(54) SYSTEMS AND METHODS FOR STORMWATER DETENTION

(71) Applicant: SUMMIT PRECAST CONCRETE LP, Montgomery, TX (US)

(72) Inventors: John Michael Ogorchock, Montgomery, TX (US); Michael Ryan Ogorchock, Montgomery, TX (US)

(73) Assignee: SUMMIT PRECAST CONCRETE LP, Montgomery, TX (US)

( * ) Notice: Subject to any disclaimer, the term of this patent is extended or adjusted under 35 U.S.C. 154(b) by 0 days.

(21) Appl. No.: 16/920,033

(22) Filed: Jul. 2, 2020

Related U.S. Application Data

(60) Provisional application No. 62/874,216, filed on Jul. 15, 2019.

(51) Int. Cl.
*E01F 5/00* (2006.01)
*E03F 1/00* (2006.01)
*E03F 5/10* (2006.01)

(52) U.S. Cl.
CPC ..... *E03F 1/005* (2013.01); *E03F 5/101* (2013.01)

(58) Field of Classification Search
CPC . E03F 1/005; E03F 5/101; E03F 1/003; E03F 1/00; C02F 2103/001; E03B 11/14; E03B 3/03
See application file for complete search history.

(56) References Cited

U.S. PATENT DOCUMENTS 634,759 A * 10/1899 Koch ..... F16L 39/00 285/150.1
5,595,703 A 1/1997 Swaelens et al.
5,848,856 A 12/1998 Bohnhoff
6,095,718 A 8/2000 Bohnhoff
(Continued)

FOREIGN PATENT DOCUMENTS

CA 2445609 4/2004
NZ 587378 3/2012
(Continued)

OTHER PUBLICATIONS lakesuperiorstreams.org, "Underground Storage", downloaded from the Internet Jan. 23, 2019, pp. 1-10, published by Lake Superior Duluth Streams.org, Duluth, MN (2019).
(Continued)

*Primary Examiner* — Carib A Oquendo
(74) *Attorney, Agent, or Firm* — Jeffrey L. Wendt; The Wendt Firm, P.C.

(57) ABSTRACT

Systems and methods for stormwater detention. An outer wall comprising L-wall members arranged side by side, each comprising a vertical stem having a height h and a width w, and a base of width w connected to the stem and extending outward therefrom at a horizontal angle. At least a first portion of the L-wall member stems having a pocket extending a distance d from a top surface of the stem towards the base, where d<h. The pockets may be positioned midway of the stem width. At least a second portion of the L-wall member stems devoid of a pocket. Optionally, support walls also having a pocket. A roof of double-T roof members each having a span, a flange, and two webs, the webs having first and second ends engaged with one of the pockets of the stems of the L-wall members.

31 Claims, 17 Drawing Sheets

(56) References Cited

U.S. PATENT DOCUMENTS

| | | | | |
|---|---|---|---|---|
| 6,478,954 | B1 | 11/2002 | Turner et al. | |
| 6,558,606 | B1 | 5/2003 | Kulkarni et al. | |
| 6,576,141 | B2 | 6/2003 | Turner et al. | |
| 6,651,825 | B2 | 11/2003 | Turner et al. | |
| 6,797,351 | B2 | 9/2004 | Kulkarni et al. | |
| 6,866,153 | B2 | 3/2005 | Turner et al. | |
| 6,991,402 | B2 | 1/2006 | Burkhart | |
| 7,160,058 | B2 | 1/2007 | Burkhart | |
| 7,344,335 | B2 | 3/2008 | Burkhart | |
| D617,867 | S | 6/2010 | May | |
| 8,285,411 | B2 | 10/2012 | Hull et al. | |
| 8,770,890 | B2 | 7/2014 | May et al. | |
| 9,428,880 | B2 | 8/2016 | May et al. | |
| 9,580,899 | B2 | 2/2017 | Rotondo et al. | |
| 9,695,584 | B2 | 7/2017 | Happel | |
| 9,951,508 | B2 | 4/2018 | May et al. | |
| 10,155,670 | B1 | 12/2018 | Happel | |
| 10,183,240 | B1 | 1/2019 | Happel | |
| 10,202,285 | B1 | 2/2019 | Happel | |
| 10,238,993 | B1 | 3/2019 | Happel | |
| 10,260,222 | B1 | 4/2019 | Happel | |
| 10,287,768 | B1 | 5/2019 | Happel | |
| 10,384,956 | B1 | 8/2019 | Happel | |
| 10,435,880 | B1 * | 10/2019 | Elliott, Jr. | E03F 1/005 |
| 10,472,815 | B1 | 11/2019 | Happel | |
| 10,538,384 | B2 * | 1/2020 | Crowther | E04H 7/18 |
| 10,794,051 | B1 | 10/2020 | Happel | |
| 2015/0151914 | A1 * | 6/2015 | Boulton | B65G 5/00 210/170.03 |
| 2020/0256048 | A1 * | 8/2020 | Crowther | E02D 27/016 |

FOREIGN PATENT DOCUMENTS

| | | |
|---|---|---|
| WO | WO 1998/035106 | 8/1998 |
| WO | WO 2016/204801 | 12/2016 |

OTHER PUBLICATIONS

"Rainstorm[3] Underground Water Storage System", downloaded from the Internet Jan. 23, 2019, pp. 1-8, published by Invisible Structures, Inc., Aurora, CO (2019).

StormPod® brochure, Rotondo Environmental Solutions, LLC, Alexandria, Virginia, pp. 1-8, Sep. 2017.

StormTech® Product Catalog, Advanced Drainage Systems Inc., Hilliard, Ohio, pp. 1-22, Apr. 2018.

Stormwater projects, Prinsco, Inc., Willmar, MN, pp. 1-2, downloaded from the Internet Jan. 23, 2019.

GeoStorage™ Underground Stormwater Detention System, pp. 1-12, ACF GeoStorage Inc., downloaded from the Internet Jan. 23, 2019, published Mar. 2010.

* cited by examiner

SYSTEMS AND METHODS FOR STORMWATER DETENTION

CROSS-REFERENCE TO RELATED APPLICATIONS

This application is entitled to and claims the benefit of earlier filed provisional application No. 62/874,216, filed Jul. 15, 2019, under 35 U.S.C. § 119(e), which earlier filed provisional application is incorporated by reference herein in its entirety.

BACKGROUND INFORMATION

Technical Field

The present disclosure relates generally to apparatus, systems, and methods for water detention, and more particularly to apparatus, systems, and methods for rainwater or stormwater detention employing precast and/or prestressed concrete members normally employed as highway retaining walls and prestressed elements used in precast and/prestressed parking structures.

Background Art

As explained on the website lakesuperiorstreams.org, on-site, underground stormwater retention/detention accomplishes the capture and storage of stormwater collected from surrounding impervious areas. Riser pipes or curb cuts lead surface storm water to subsurface vaults or systems of large diameter interconnected storage pipes or chambers. Stored water is then released directly through an outlet pipe back into natural waters at rates designed to reduce peak water flows during storms to mimic pre-development conditions. In some cases, stored water can be allowed to infiltrate to recharge groundwater (if soil types are suitable and the groundwater table is located sufficiently below the water storage units). Underground stormwater storage provides minimal stormwater quality benefits but can be a successful segment to a development's overall stormwater management plan, when coupled in-line with other stormwater best management practices (BMPs). The addition of pretreatment features at the system's inlet can facilitate improvements to water quality by removing floatables, skimming of oils and grease and trap some level of sediments through deposition. Pretreatment is most important if stored water is to be allowed to infiltrate into the soil, otherwise rapid clogging of the system could occur. Pretreatment features can be designed and built into the system or there are commercially available, prefabricated units that can be incorporated within the system during initial planning and design.

As further noted on this website, subsurface storage typically relies on construction of water storage structures made of concrete (vaults) or large diameter, rigid pipes or arches with capped ends made of plastic, steel or aluminum. A number of pre-built, modular systems are commercially available. Storage structures, inlet and outlet pipes and maintenance access (man holes) are fitted and attached in a predetermined excavated area and then the entire area is back-filled to surrounding landscape surface height with gravel and subsequently surfaced. A summary of presently available solutions is now discussed.

SUMMARY OF EXISTING DETENTION STRUCTURES

The stormwater management systems known under the trade designation STORMPOD, currently available from Rotondo Environmental Solutions LLC, Alexandria, Va. (U.S.A.) and believed to be disclosed in U.S. Pat. No. 9,580,899B2 and published international patent application WO2016204801A1, utilize precast arch units that are placed above either precast columns or precast sidewall sections. These systems require a precast concrete floor base set on a 6-inch stone bed above a compacted sub-base. There are hundreds of precast units needed for a typical project. Since access is very difficult with no access for rolling cleaning equipment, maintenance needs to be performed manually. The systems require extended time at the project site for excavation, drainage, sub-base, select subgrade material placement and installation of precast concrete elements. The systems are very labor intensive in manufacturing, shipping and installation, and also require sub-base and thicker concrete paving for a parking lot placed above it.

The stormwater management systems known under the trade designation STORMTRAP, currently available from StormTrap, Romeoville, Ill. (U.S.A.) utilize precast concrete elements that are rectangular units in top and bottom sections plus single height units. The systems also require a precast base unit with a floor set on a stone bed. The company lists their patents on their website. Compared to the stormwater management systems known under the trade designation STORMPOD, the stormwater management systems known under the trade designation STORMTRAP have fewer units but still rely on heavy precast units. Access to the detention chamber is limited and poses maintenance issues.

The stormwater management systems known under the trade designation RAINSTORE$^3$, currently available from Invisible Structures, Inc., Aurora, Colo., (U.S.A.) utilize injection molded plastic modular and stackable units. The systems are believed to be disclosed in U.S. Pat. Nos. 5,848,856 and 6,095,718 and published international patent application WO1998035106A1. The units are 1-meter square by 10 centimeters high. There are hundreds of units to place and secure in a typical project, making the system very labor intensive, and these units must be wrapped in layers of geosynthetic blankets to protect the system from erosion and intake of silt-born stormwater. The deepest installation is less than 8 ft. rendering it very inefficient in both installation cost and extended construction time. The systems also have a large footprint that equates to wasted land utilization.

The stormwater management systems known under the trade designation STORMTECH, currently available from StormTech, a division of Advanced Drainage Systems, Inc. (ADS) comprise a polypropylene copolymer chamber system that is 5 ft. high by 8 ft. wide by 4 ft long arch units. Each unit delivers 185 cubic feet of detention capacity. The company has many patents, but it is unclear from the patents which patents disclose the stormwater management systems that StormTech markets. An example of capacity of these systems: it takes 400 units to deliver 74,000 cubic feet of detention with a footprint of 15,500 square feet. This is 2.5 times the footprint that the systems of the present disclosure require. The stormwater management systems known under the trade designation STORMTECH also require extensive over-excavation of the site and placement of a rock bed below the structure and select backfill above the structure to sub-finish grade below the stabilized base and concrete paving. The stormwater management systems known under the trade designation STORMTECH also need approximately 500 product pieces and over 50,000 square feet of woven filter fabric to place, making the design very inefficient in both construction cost and extended construction time in the below grade activity.

The stormwater management systems offered by Prinsco Inc., Willmar, Minn. (U.S.A.) also comprise a series of long runs of polypropylene pipe installed in parallel rows, providing parallel chambers. Most of the characteristics of the stormwater management systems offered by Prinsco Inc. appear to be the same as the stormwater management systems known under the trade designation STORMTECH as described above. The stormwater management systems offered by Prinsco require hundreds of product pieces, thousands of tons of rock bed, and select backfill, and thousands of square feet of woven filter fabric. These systems also are very labor intensive and require extended time in a construction zone below natural grade.

As may be seen, while many proposals exist to manage stormwater, there remains a need for apparatus, systems, and methods with more advanced, robust, and flexible solutions while detaining large volumes of stormwater. Presently available systems may not be adequate for all circumstances, may lead to premature repairs or equipment replacements, and at worst may result in injury to inspectors, or to other personnel or the public if an asset fails while in use. There remains a need for safer, less expensive, less labor-intensive, more robust stormwater detention systems and methods. The systems and methods of the present disclosure are directed to these needs.

SUMMARY

In accordance with the present disclosure systems and methods for stormwater detention are described which reduce or overcome many of the faults of previously known systems and methods.

A first aspect of the disclosure is a system for stormwater detention, the system comprising:

an outer wall comprising a first plurality of L-wall members, a second plurality of L-wall members, and a third plurality of L-wall members arranged side by side and connected, the L-wall members each comprising a substantially vertical stem having a height h and a width w, and a base of width w connected to the stem and each having a forebase and a hindbase extending outward from the stem at a substantially horizontal angle, the forebase extending longer than the hindbase, at least a portion of the first and second plurality of L-wall member stems having a pocket extending a distance d from a top surface of the stem towards the base, where d<h, the pockets positioned substantially midway of the stem width, and the third plurality of L-wall member stems devoid of a pocket, the forebases facing inward of the outer wall and the hindbases facing outward of the outer wall;

a plurality of T-wall members arranged side by side and connected to form an inner support wall, the T-wall members each comprising a substantially vertical stem having a height h and a width w, and a base of width w connected to the stem and each having a forebase and a hindbase extending outward from the stem at a substantially horizontal angle, the forebase and the hindbase extending substantially equidistant from the stem, the stems of the plurality of T-wall members having a pocket extending a distance d from a top surface of the stem towards the base, where d<h, the pockets positioned substantially midway of the stem width;

optionally, one or more support members positioned under the first plurality of double-T members, the one or more support members selected from the group consisting of L-wall members, T-wall members, columns, and combinations thereof;

a roof comprising a first plurality of double-T roof members and a second plurality of double-T members, each having a span, a flange, and two webs, the webs having first and second ends engaged with one of the pockets of the stems of the first and second plurality of L-wall members; and at least one stormwater inlet and at least one stormwater outlet.

In certain embodiments the first, second, and third pluralities of L-wall members may comprise a plurality of precast cantilever L-wall members with at least the hindbases of each L-wall member positioned under reinforced backfill mass. In certain embodiments each of the plurality of L-wall members, T-wall members, and double-T roof members may comprise precast and prestress concrete elements. Certain embodiments may be devoid of the one or more support members. In certain embodiments one or more of the L-wall members may be configured with a camera to provide live visual inspection feed to one or more user interfaces remote from the L-wall members. Certain embodiments may comprise one or more manways for accessing an interior space of the system. Certain embodiments may comprise a concrete floor. In certain embodiments the concrete floor may comprise at least one stormwater outlet conduit. Certain embodiments may comprise one or more stormwater inlet filters and/or one or more pumps for pumping stormwater out of the system.

A second aspect of the disclosure is a system for stormwater detention, the system comprising:

an outer wall comprising a first plurality of L-wall members, a second plurality of L-wall members, and a third plurality of L-wall members arranged side by side and connected, the L-wall members each comprising a substantially vertical stem having a height h and a width w, and a base of width w connected to the stem and each having a forebase and a hindbase extending outward from the stem at a substantially horizontal angle, the forebase extending longer than the hindbase, at least a portion of the first and second plurality of L-wall member stems having a pocket extending a distance d from a top surface of the stem towards the base, where d<h, the pockets positioned substantially midway of the stem width, and the third plurality of L-wall member stems devoid of a pocket;

the system devoid of T-wall members arranged side by side and connected to form an inner support wall;

optionally, one or more support members positioned under the first plurality of double-T members, the one or more support members selected from the group consisting of L-wall members, T-wall members, columns, and combinations thereof;

a roof comprising a plurality of double-T roof members, each having a span, a flange, and two webs, the webs having first and second ends engaged with one of the pockets of the stems of the plurality of L-wall members; and at least one stormwater inlet and at least one stormwater outlet.

A third aspect of the disclosure is a system for stormwater detention, the system comprising:

an outer wall comprising a first plurality of L-wall members, a second plurality of L-wall members, and a third plurality of L-wall members arranged side by side and connected, the L-wall members each comprising a substantially vertical stem having a height h and a width w, and a base of width w connected to the stem and each having a forebase and a hindbase extending outward from the stem at a substantially horizontal angle, the forebase extending longer than the hindbase, at least a portion of the first and second plurality of L-wall member stems having a pocket extending a distance d from a top surface of the stem towards the base, where d<h, the pockets positioned substantially midway of the stem width, and the third plurality of L-wall member stems devoid of a pocket, the forebases facing outward of the outer wall and the hindbases facing inward of the outer wall;

a plurality of T-wall members arranged side by side and connected to form an inner support wall, the T-wall members each comprising a substantially vertical stem having a height h and a width w, and a base of width w connected to the stem and each having a forebase and a hindbase extending outward from the stem at a substantially horizontal angle, the forebase and the hindbase extending substantially equidistant from the stem, the stems of the plurality of T-wall members having a pocket extending a distance d from a top surface of the stem towards the base, where d<h, the pockets positioned substantially midway of the stem width;

optionally, one or more support members positioned under the first plurality of double-T members, the one or more support members selected from the group consisting of L-wall members, T-wall members, columns, and combinations thereof;

a roof comprising a first plurality of double-T roof members and a second plurality of double-T members, each having a span, a flange, and two webs, the webs having first and second ends engaged with one of the pockets of the stems of the first and second plurality of L-wall members; and at least one stormwater inlet and at least one stormwater outlet.

A further aspect of the disclosure are methods of installing the stormwater detention systems.

These and other features of the systems and methods of the disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain systems and methods may comprise a number of physical components and features but may be devoid of certain optional hardware and/or other features. In certain systems and methods, for example, the stormwater detention system may be devoid of T-wall members, or devoid of support members. Stormwater detention systems may be devoid of components that would render the stormwater detention system unsafe, according to American Association of State Highway and Transportation Officials (AASHTO) standards and other industry standards discussed herein.

BRIEF DESCRIPTION OF THE DRAWINGS

The manner in which the objectives of this disclosure and other desirable characteristics can be obtained is explained in the following description and attached drawings in which:

It is to be noted, however, that the appended drawings may not be to scale and illustrate only typical embodiments of this disclosure. Furthermore, FIGS. 13-16 illustrate only four of many possible methods of this disclosure. Therefore, the drawing figures are not to be considered limiting in scope, for the disclosure may admit to other equally effective embodiments. Identical reference numerals are used throughout the several views for like or similar elements.

DETAILED DESCRIPTION

Figure 1:
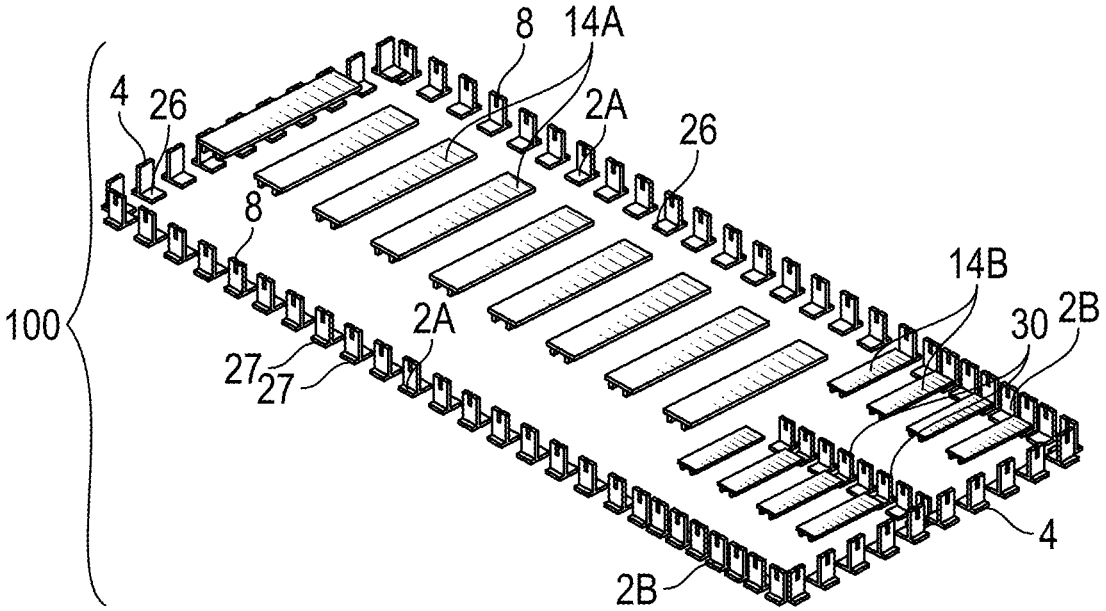
FIG. 1 is an exploded schematic perspective illustration.

In the following description, numerous details are set forth to provide an understanding of the disclosed water detention systems and methods. However, it will be understood by those skilled in the art that the systems and methods disclosed herein may be practiced without these details and that numerous variations or modifications from the described embodiments may be possible. All U.S. published patent applications and U.S. patents referenced herein are hereby explicitly incorporated herein by reference, irrespective of the page, paragraph, or section in which they are referenced. Where a range of values describes a parameter, all sub-ranges, point values and endpoints within that range are explicitly disclosed herein.

The various embodiments of the present disclosure address the deficiencies in existing systems and methods and provide increased detention capacity and reduced cost and complexity in comparison to existing systems and methods. The various system embodiments of the present disclosure comprise of a system of concrete, in elements, in certain embodiments precast and/or prestressed concrete elements, for efficient collection and storage of rain water and water runoff detention. Systems and methods of the present disclosure introduce a new concept: use of large span roof members comprised of prestressed concrete members supported by load bearing retaining walls and optional support structures. This concept greatly increases the water detention per acre compared to existing systems in the marketplace. Some existing systems utilize many small precast concrete or polymeric elements. Others utilize galvanized piping chambers or plastic chambers. One common aspect of existing systems is that they have many pieces to install, the detention capacity is limited by the shapes and sizes of design limitations, and they are very expensive to manufacture, ship and install.

Systems and methods of the present disclosure offer time saving on site for excavation, pad site, concrete work, foundations, assembly and backfill in an area that is commonly in a low-lying area for an extended amount of time. Systems and methods of the present disclosure may be installed on site in a much shorter time frame compared with conventional systems.

Systems and methods of the present disclosure offer at least four options for the precast wall system depending on wall height and local soils conditions. Option 1: a precast outer L-Wall with the wall foundation under the reinforced backfill mass, covered by two sizes of prestressed concrete "double-T" roof members, using a plurality of T-wall members to form an inner wall supporting some of the double-T members. Option 2: like Option 1, but without the T-wall members, using only a set of single span size double-Ts. Option 3: like Option 1, but with extra interior supports (for example L-wall members, T-wall members, or columns). Option 4: like Options 1-3, but where the L-walls are "reversed" in position, as explained further herein.

Systems and methods of the present disclosure offer considerable savings to the project owner by delivering greater stormwater detention capacity: for example, an existing system project design utilizes 15,500 square feet of land to deliver 75,250 cubic feet of storage. A system and method of the present disclosure may utilize 6480 square feet to deliver 77,750 cubic feet of storage. The savings to the owner in land utilization is an added benefit beyond the on-site construction costs. The additional cost savings to the owner increases using systems and methods of the present disclosure by utilizing the roof as a parking structure instead of a traditional concrete parking lot above a detention system currently in the marketplace that requires select backfill, stabilizing the sub base and pouring a thicker paving depth for the parking lot.

Certain embodiments of systems and methods of the present disclosure may utilize heavy duty industrial grade top mounted trash pumps to drain the detention structure after a rain event. This feature greatly improves the efficiency of systems and methods of the present disclosure to allow design of deeper and higher volume structures with a smaller footprint. The existing systems rely on gravity flow to drain their structures after a rain event. This is a very inefficient design flaw controlled by external events and thus requires a much larger and costly footprint to accomplish proper rainwater detention. Certain systems and methods of the present disclosure may offer a hybrid option where a natural exit flow design drains the upper section of the detention structure down to the natural flow line by gravity flow and a pump system drains the area below the natural flow line. Certain embodiments may also include backup generators in the event public power is lost.

The primary features of the systems and methods of the present disclosure will now be described with reference to the drawing figures, in which some of the construction and operational details, some of which are optional, will be further explained. The same reference numerals are used throughout to denote the same items in the figures. Those skilled in this art will know the basics of producing precast and prestressed concrete. Sources of background information include the Precast Concrete Institute (PCI); American Association of State Highway and Transportation Officials (AASHTO); National Precast Concrete Association (NPCA); and American Society of Testing materials (ASTM), to name a few.

Certain stormwater detention system embodiments, such as embodiment 100 illustrated schematically in FIG. 1, may employ first and second pluralities of load-bearing, pocketed, precast concrete L-wall members 2A and 2B, and a third plurality of non-load-bearing, non-pocketed precast concrete L-wall members 4 to contain water. L-wall members 2A and 2B each have a forebase 26 and a hindbase 27, using terminology of the human foot, and a stem 24. One or more or all of the L-wall members may be comprised of prestressed, precast concrete. L-wall members 2A and 2B each comprise a pocket 8, as further described in relation to FIG. 4. Embodiment 100 further features a first plurality of double-T-members 14A, and a second plurality of double-T members 14B, where double-T members 14A each span the entire width of the stormwater detention system, whereas double-T members 14B each span only about one-half of the entire width and are supported by an L-wall on one of their ends, and by one or more T-walls 30 on their other end. Certain embodiments, like embodiment 300 as illustrated schematically in FIG. 11, may optionally include one or more (or a plurality of) load-bearing, pocketed, precast concrete T-wall members 30 for supporting double-T members 14A. The various components are positioned and connected as further described herein. The double-Ts, L-wall members, and T-wall members may each have rebar mesh therein. As noted in FIG. 1A, the system may include a surface covering 16, either pre-installed on the double-T members, or applied after construction of the deck or roof 12.

Figure 1A:
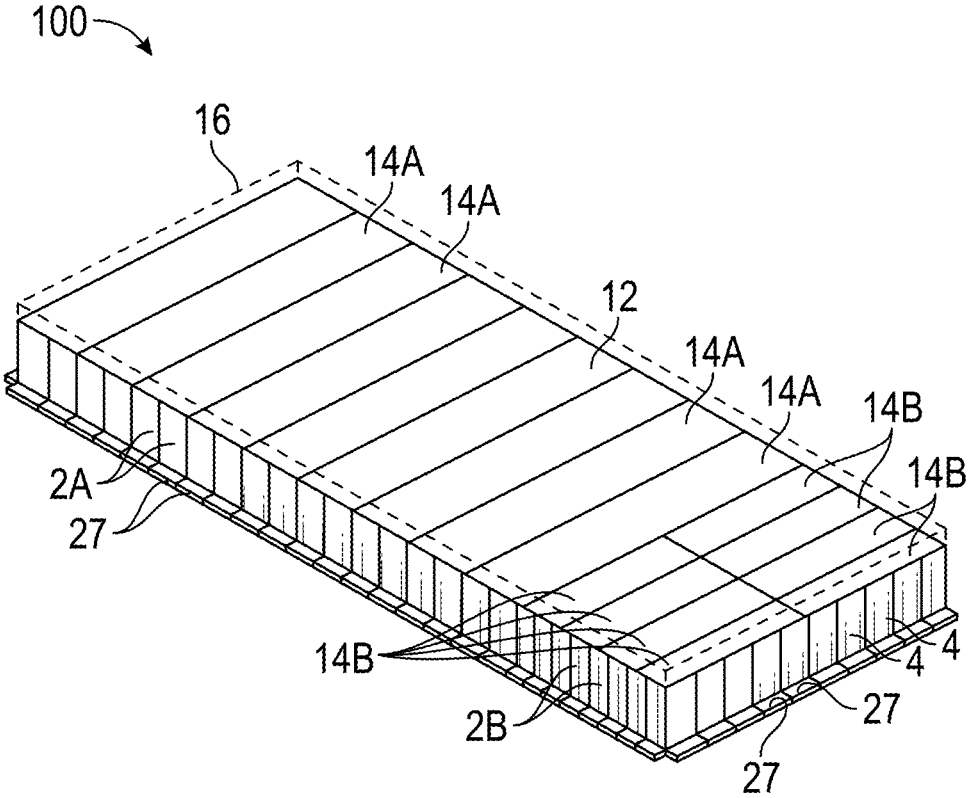
FIG. 1A is a schematic perspective view of one embodiment of the present disclosure.
Figure 2:
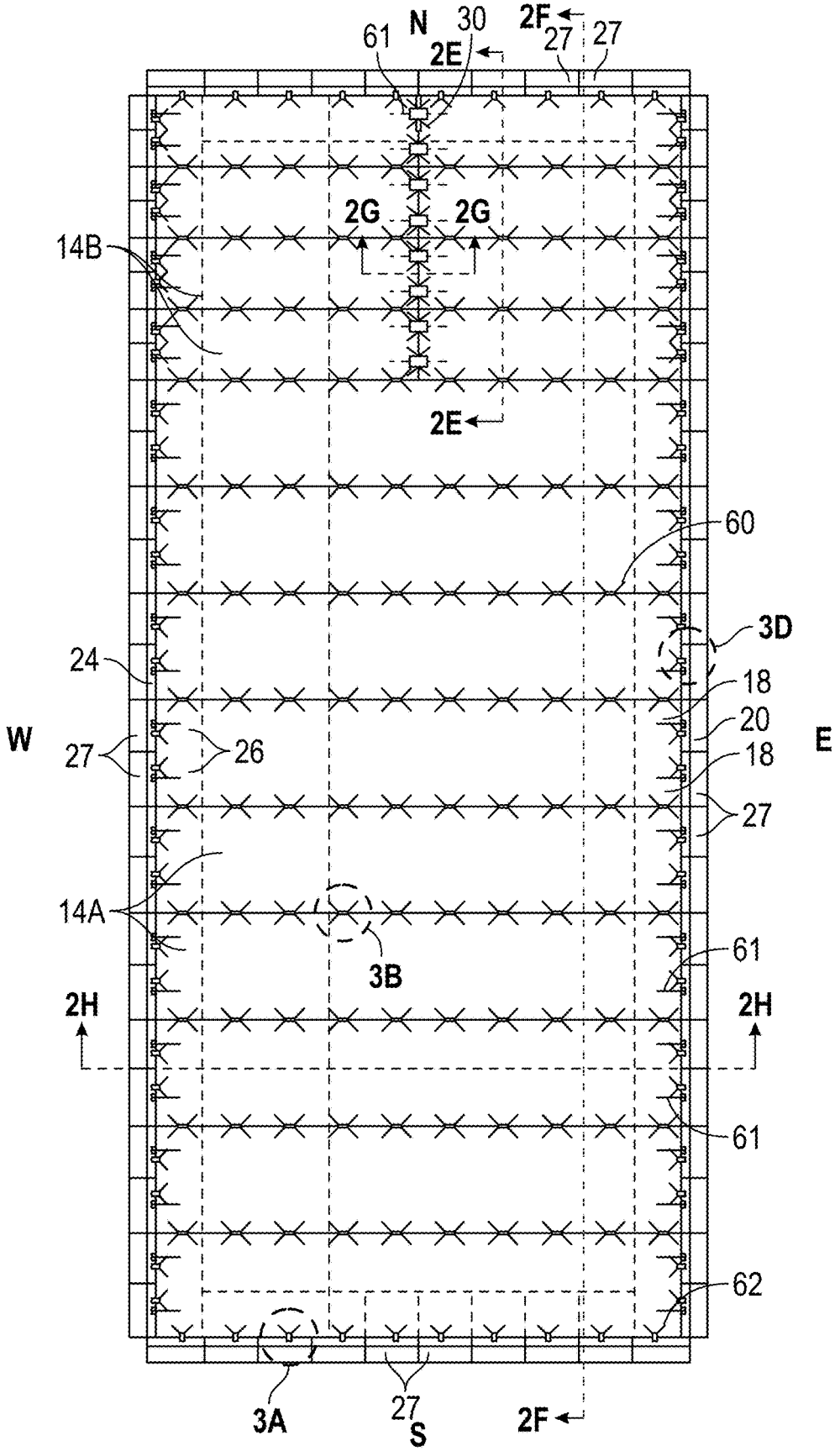
FIG. 2 is a schematic plan view, with some features in phantom, of the embodiment illustrated schematically in FIGS. 1 and 1A.

FIG. 2 is a schematic plan view, with some features in phantom, of embodiment 100 illustrated schematically in FIGS. 1 and 1A, illustrating some construction details as well as indicating cross-sectional views for FIGS. 2E, 2F, 2G, and 2H, and detailed views in FIGS. 3A, 3B, 3C, and 3D. Iron or steel lifting loops 61 may be provided, and these may be precast into the double-T members, typically one near each corner and galvanized.

Figure 2A:
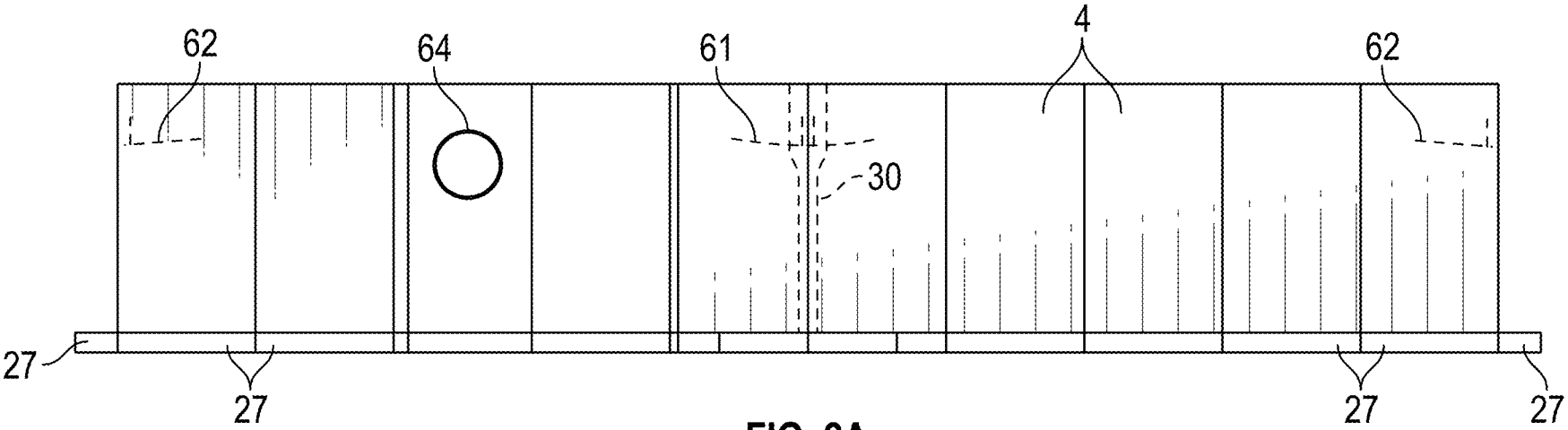
FIGS. 2A, 2B, 2C, 2D, and 2E are schematic elevation views of the embodiment illustrated schematically in FIGS. 1, 1A, and 2.
Figure 2B:
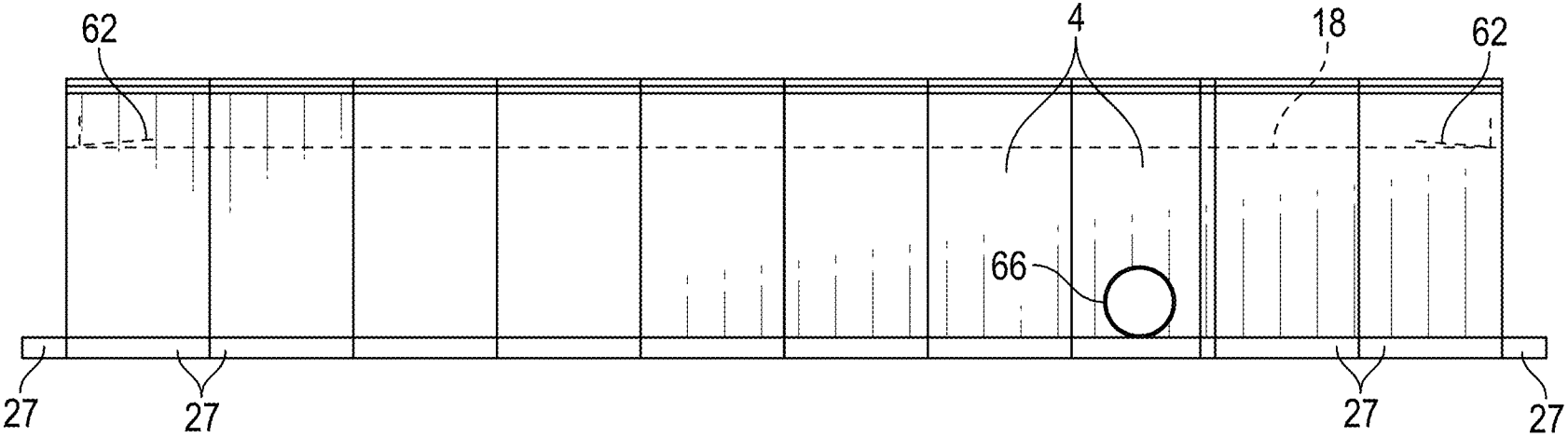
Figure 2C:
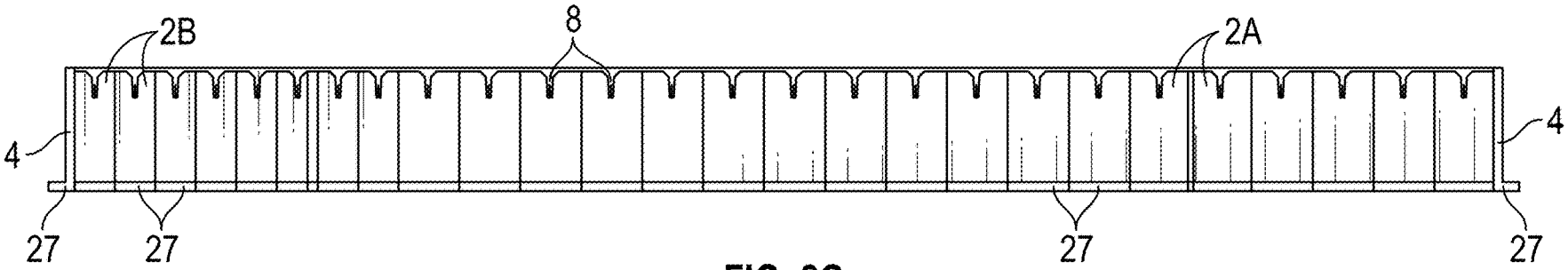
Figure 2D:
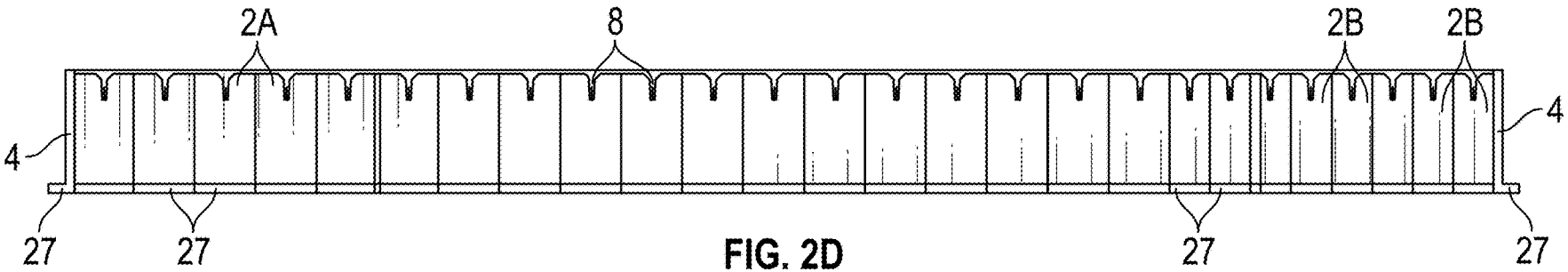
Figure 2E:
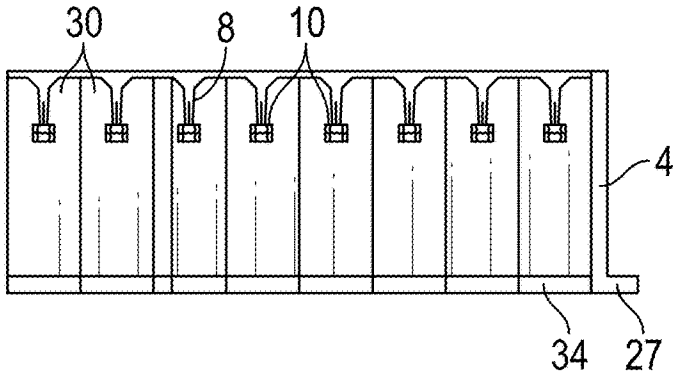
Figure 2F:
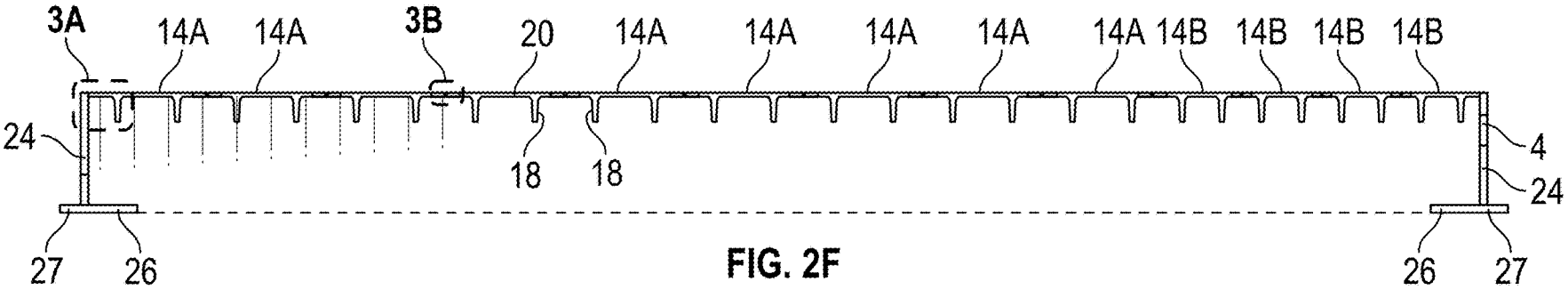
FIGS. 2F, 2G, and 2H are schematic cross-sectional views of the embodiment illustrated schematically in FIGS. 1, 1A, and 2.
Figure 2G:
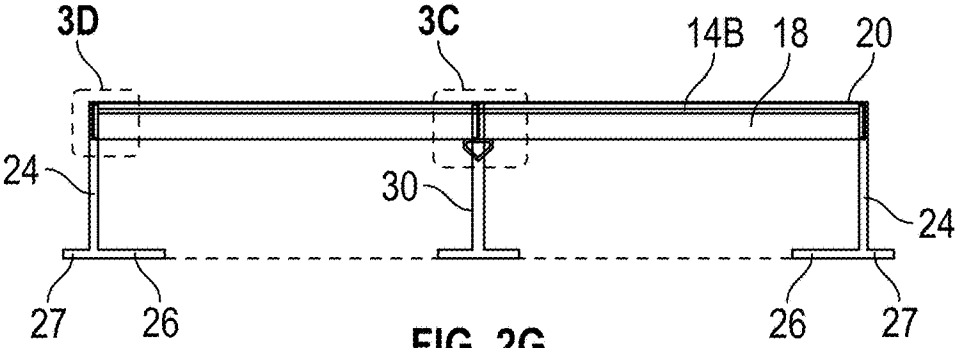
Figure 2H:
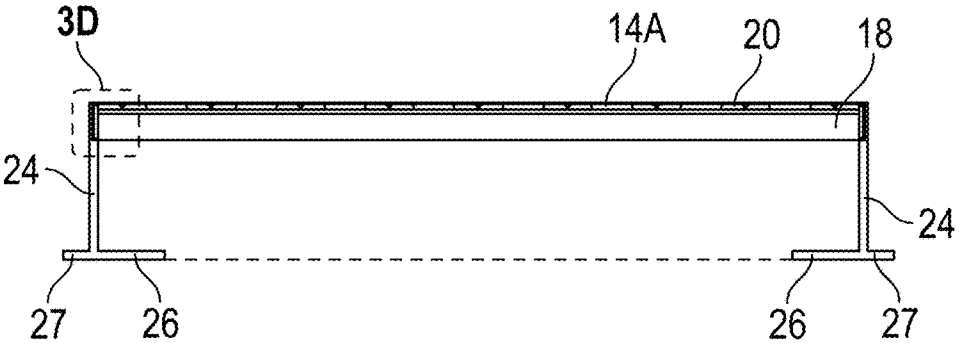

FIGS. 2A, 2B, 2C, 2D, and 2E are schematic elevation views of embodiment 100 illustrated schematically in FIGS. 1, 1A, and 2. FIG. 2A is a north (N) end elevation view; FIG. 2B is a south (S) end elevation view; FIG. 2C is a west (W) end elevation; FIG. 2D is a east (E) end elevation view; and FIG. 2E is an elevation view taken along the line 2E-2E indicated in FIG. 2. The directions N, S, W, and E are indicated in FIG. 2 as well. As indicated in these drawing figures, pockets 8 provide connection points for webs 18 of the various double-T members 14A, 14B. Pockets 8 are supported by corbels 10 in the inner support wall illustrated schematically in FIG. 2E. As also illustrated in FIGS. 2, 2A-2H the forebases 26 of each L-wall 2A, 2B, and 4 face inwards from the outer wall, while the hindbases 27 of each L-wall 2A, 2B, and 4 face outwards from the outer wall of the structure.

Figure 3B:
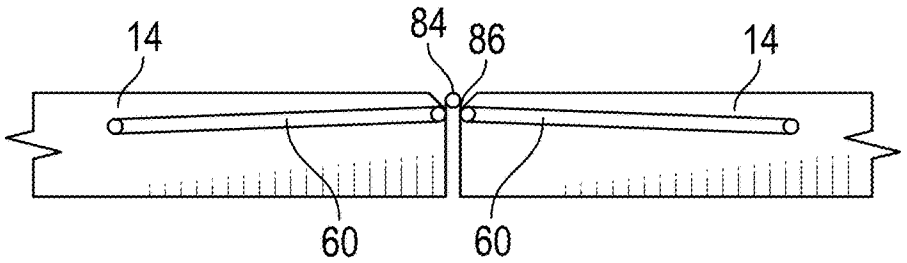
FIGS. 3A, 3B, 3C, and 3D are detailed schematics of features of the embodiment illustrated schematically in FIGS. 1, 1A, and 2.
Figure 3D:
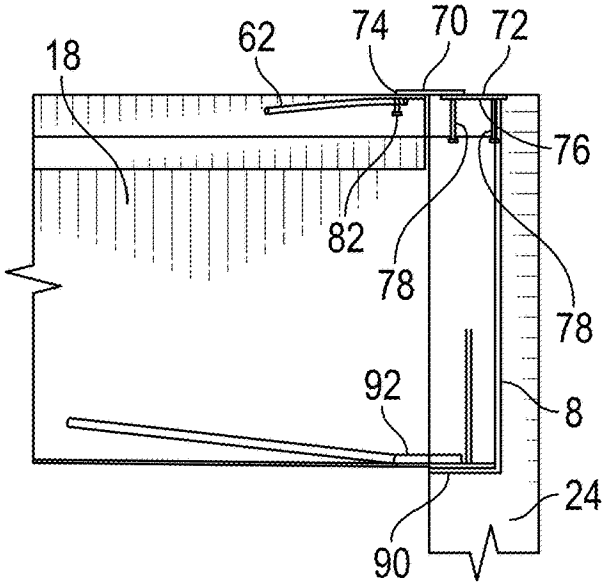
Figure 3A:
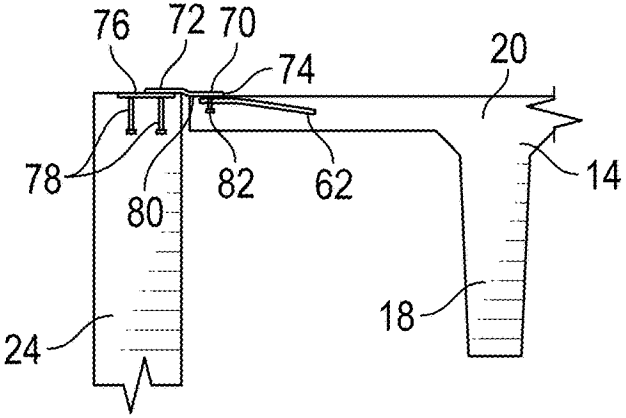
Figure 3C:
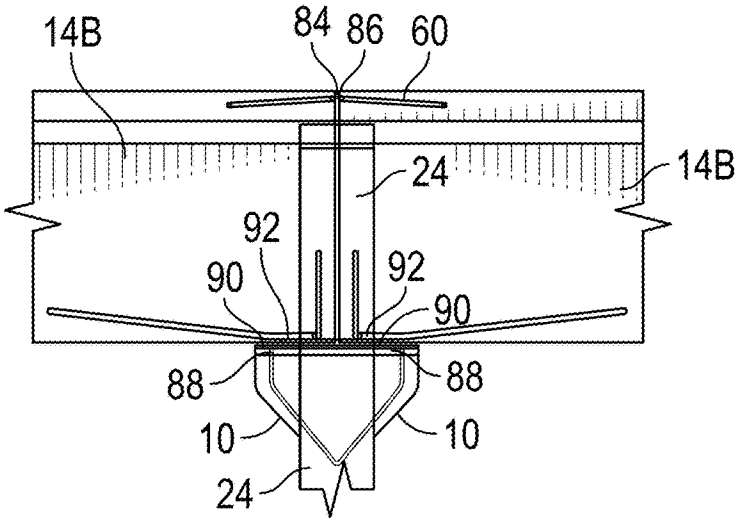

Referring now to the detailed schematics of FIGS. 3A-D, FIG. 3A illustrates schematically one construction that may be used to connect a flange 20 of a double-T member 14 to a stem 24 of a non-pocketed L-wall member. These connections may be used for stability during erection, structural movements, and transferring diaphragm loads as part of the lateral-load resisting system. Precast embed plates 76 and 80 may be designed and cast into the precast elements 24 and 18, respectively. Embedded wall panel plate 76 is connected to the embedded double-T plate 80 by erection hardware, in this particular embodiment a strap metal plate 70. Strap metal plate 70 is welded to the precast embed plates 76 and 80 using welds 72, 74 to complete the connection. The type, size, and length of welds 72, 74, and weld materials, depend on the specific loads and other construction details. Fillet welds may be preferred in some embodiments. Headed concrete anchors (HCA) 78 (typically 4 are used, although more or less may also be employed), as well as HCAs 82 (two may be used, although more or less may suffice). Element 62 is typically a 135-degree bend. The plates, HCAs, and bends are typically galvanized metal, i.e. zinc coated iron or steel, although that may not be required in all embodiments. FIG. 3B illustrates schematically one connection between two double-T members 14, employing galvanized iron or steel bar 84 welded at 86 to a 135-degree bend. FIG. 3C illustrates schematically one connection that may be employed between two double-T members 14B and a stem 24 of a T-wall member, including the connection detailed in FIG. 3B, as well as cotton duck fabric bearing pads 90 one each side, with plate and bar assembly 92. A corbel 10 is illustrated, with internal rebar 88 illustrated in phantom. FIG. 3D illustrates schematically a similar connection between a pocket 8 of a pocketed L-wall stem 24 and a web 18 of a double-T member.

Figure 4:
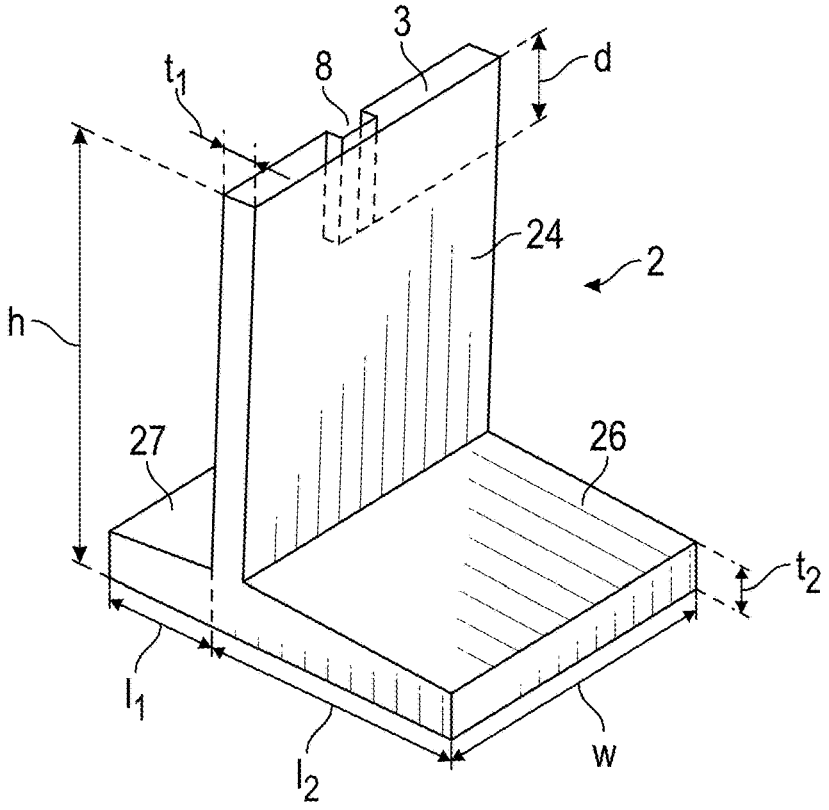
FIGS. 4, 5, 6, 7, 8, 9, and 9A are schematic perspective illustrational views of components of the systems of the present disclosure (some are optional, such as the precast filter box illustrated in FIG. 9A)
Figure 5:
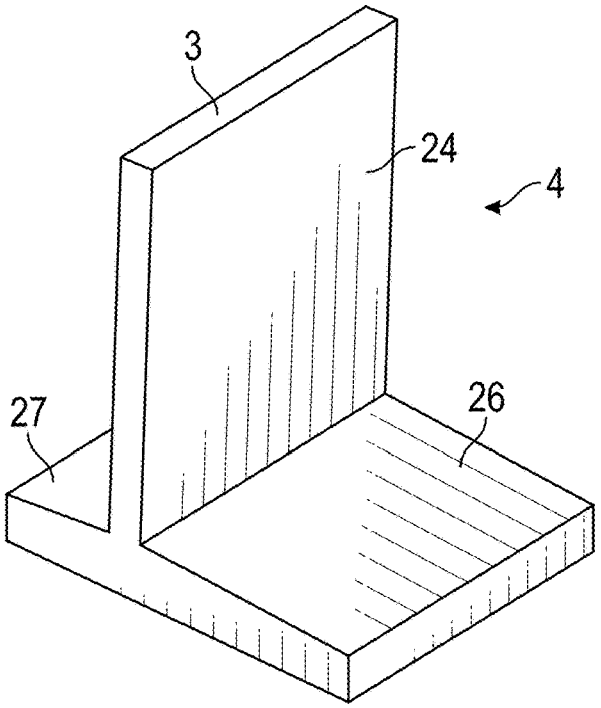

Referring now briefly to FIGS. 4 and 5, more detailed perspective views are illustrated of one of the load-bearing, pocketed, precast concrete L-wall members 2, and one of the non-load-bearing, non-pocketed precast concrete L-wall members 4, respectively. In particular, FIG. 4 illustrates a height "h" of a stem 24, a depth "d" of pocket 8, a width "w" of the L-wall member, a length "$l_1$" of hindbase 27, a length "$l_2$" of forebase 26, a thickness "$t_1$" of a stem 24, and a thickness "$t_2$" of forebase 26 and hindbase 27. A top surface 3 is also illustrated. L-wall member 4 illustrated schematically in FIG. 5 is similar but has no pocket. It should be noted that thickness $t_2$ may be representative of thickness of hindbase 27 as well as forebase 26; but they may be the same or different. Table 1 provides broad and narrow ranges for h, $l_1$, $l_2$, d, w, $t_1$, and $t_2$ for L-wall members.

TABLE 1

Dimensions for L-Wall members

| L-wall Feature | Broad range (meters) | Less broad range (meters) |
|---|---|---|
| h | 0.5-20 | 3-15 |
| d | 0.05-2 | 0.05-0.5 |
| w | 0.5-3 | 0.5-1 |
| $l_1$ | 0.1-1 | 0.5-1 |
| $l_2$ | 0.5-3 | 1-2 |
| $t_1$ | 0.01-0.2 | 0.01-0.1 |
| $t_2$ | 0.1-0.5 | 0.2-0.3 |

Figure 6:
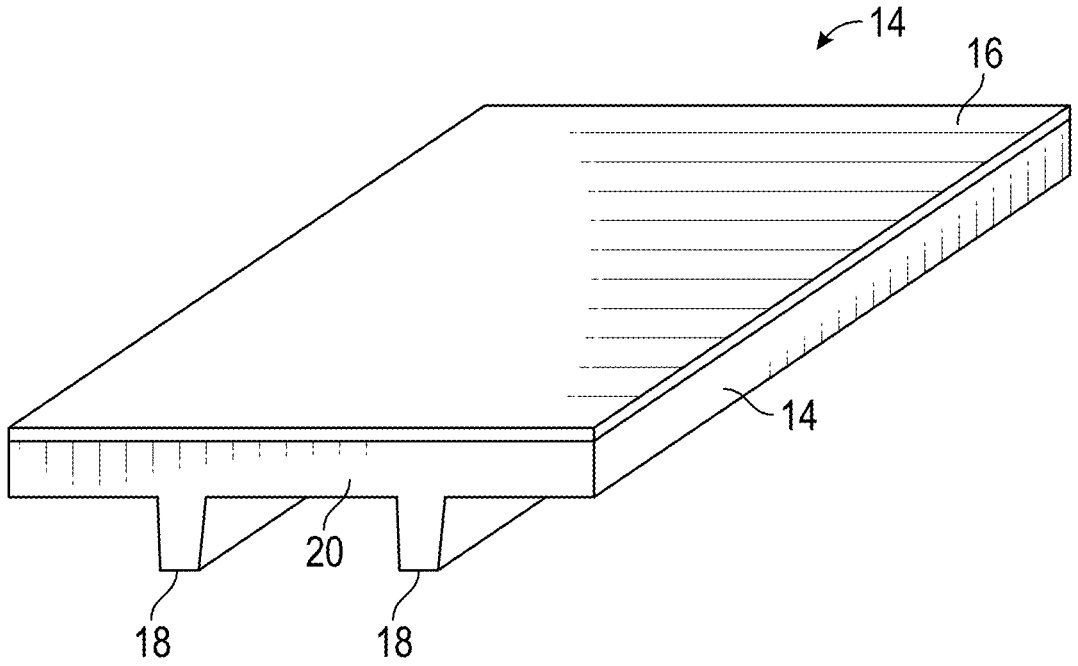

Referring again to FIG. 1, system embodiment 100 includes a roof 12 composed of one or more (or a plurality of) concrete double-T roof members 14A and 14B, having an optional top surface 16, for example a surface suitable for a parking lot. Optional surface 16 may be pre-topped or constructed on site using conventional materials and methods. Referring to FIG. 6, double-T roof members may each be precast and prestressed concrete, and each have a pair of webs 18, a flange 20, and a span 22, which may be several feet or meters. Double-T (sometimes also referred to as "double tee") members are commercially available. Ends of webs 18 fit into respective pockets 8 of L-wall members (2, 2A, 2B) and a mid-location of webs 18 may fit into pockets 8 of supporting L-wall members, T-wall members, or columns (if present). This of course depends upon the length of span 22 of double-T roof members, soil conditions, expected loads on the structure, and the like. Optional surface 16 may, if used, contribute to the strength of roof 12 by in part binding together adjacent double T-wall members. Alternatively, or in addition thereto, double-T wall members 14 may be joined using one or more connectors used in the concrete industry, such as ship-lap joints, dowels, and the like. FIGS. 3A-D provide non-exclusive examples of connections that may be employed during erection and during use of the systems (in other words, after completion of construction).

Figure 7:
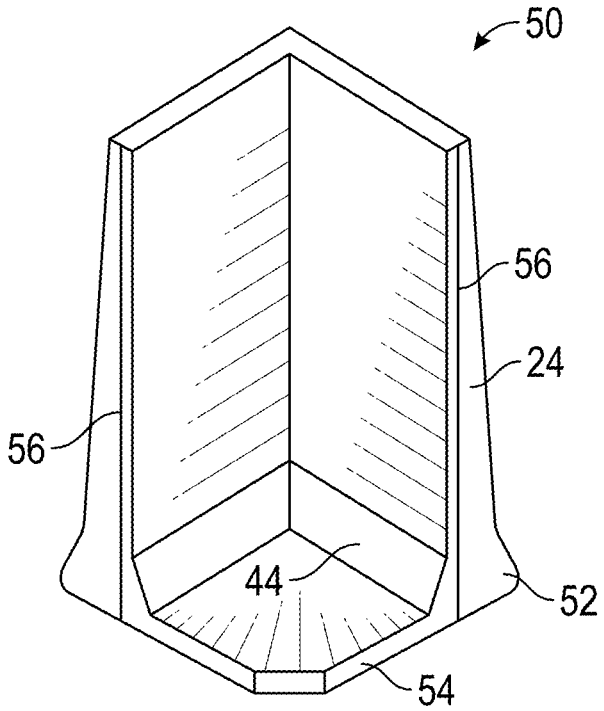

Certain system embodiments in accordance with the present disclosure may be constructed including corner pieces 50 ("corners") such as illustrated in the schematic perspective view of FIG. 7, each corner 50 including a 90-degree stem 24, a stub base portion 52 extending a short distance away from the water detention area, a corner base 54, and optional extra support feature 44. Shiplap joints 56 may be included, as well as other joining features known in this art.

Figure 8:
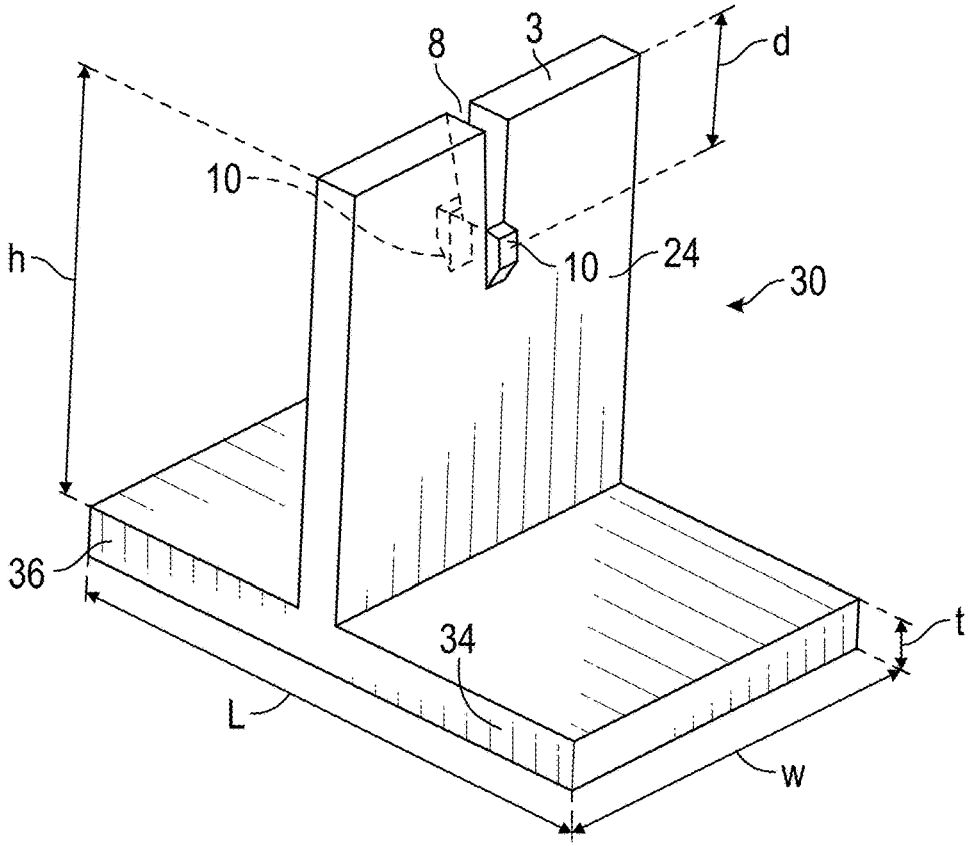
Figure 9:
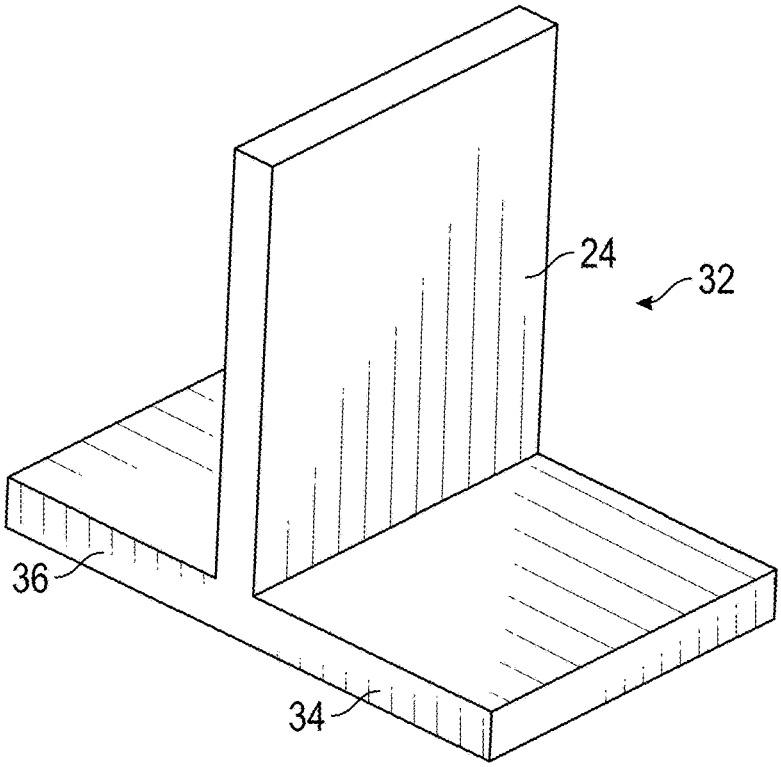

Referring to FIGS. 8 and 9, certain system embodiments such as embodiment 100 in accordance with the present disclosure may be constructed employing a plurality of load-bearing T-wall members 30, each having a base portion 34 and another base portion 36. Additionally, a plurality of load-bearing support T-wall members 32 may be provided, each also having a base portion 34 and another base portion 36. FIGS. 8 and 9 illustrate schematically physical features height "h", width "w", thickness "t", depth "d", and length "L" of the base. In these embodiments, base members 34, 36 may each be one-half of L, or base members 34, 36 may have unequal lengths. Table 2 provides broad and narrow ranges for h, L, d, w, and t for T-wall members.

TABLE 2

Dimensions for T-Wall members

| L-wall Feature | Broad range (meters) | Less broad range (meters) |
|---|---|---|
| h | 0.5-20 | 3-15 |
| d | 0.05-2 | 0.05-0.5 |
| w | 0.5-3 | 0.5-1 |
| L | 1-6 | 1-2 |
| t | 0.01-0.2 | 0.01-0.1 |

Figure 10:
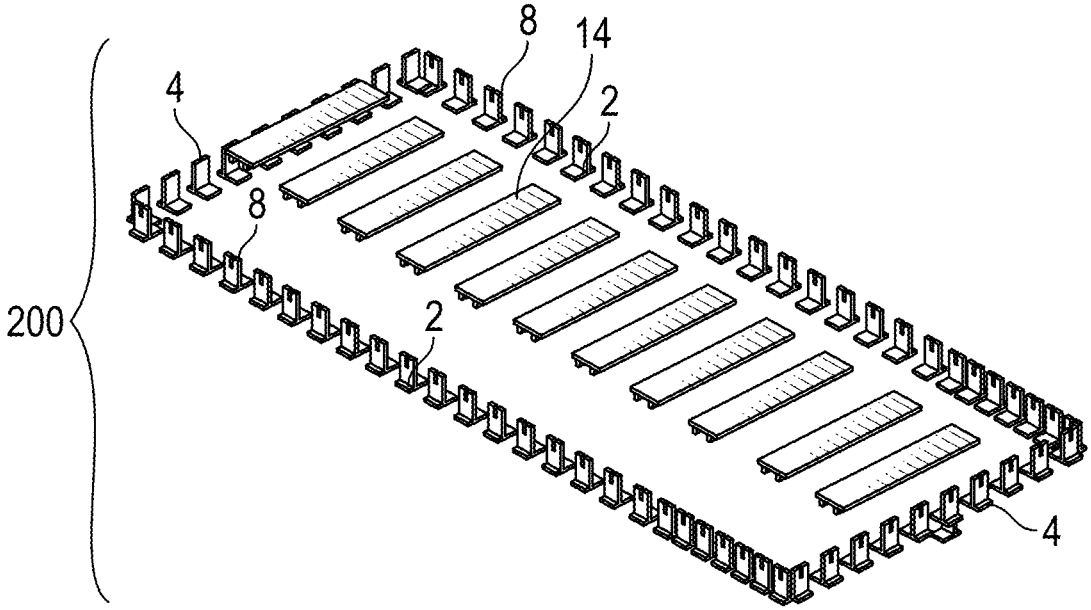
FIGS. 10, 11, and 12 are exploded schematic perspective illustrations.
Figure 10A:
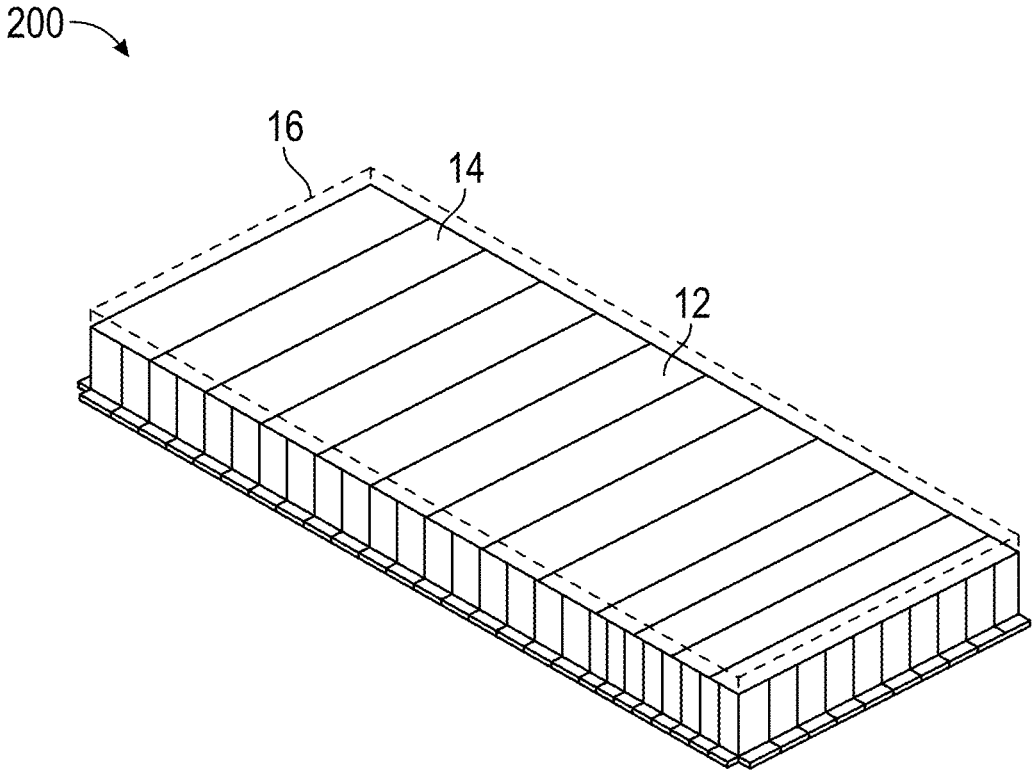
FIGS. 10A, 11A, and 12A are schematic perspective illustrations of further embodiments of the present disclosure.
Figure 11:
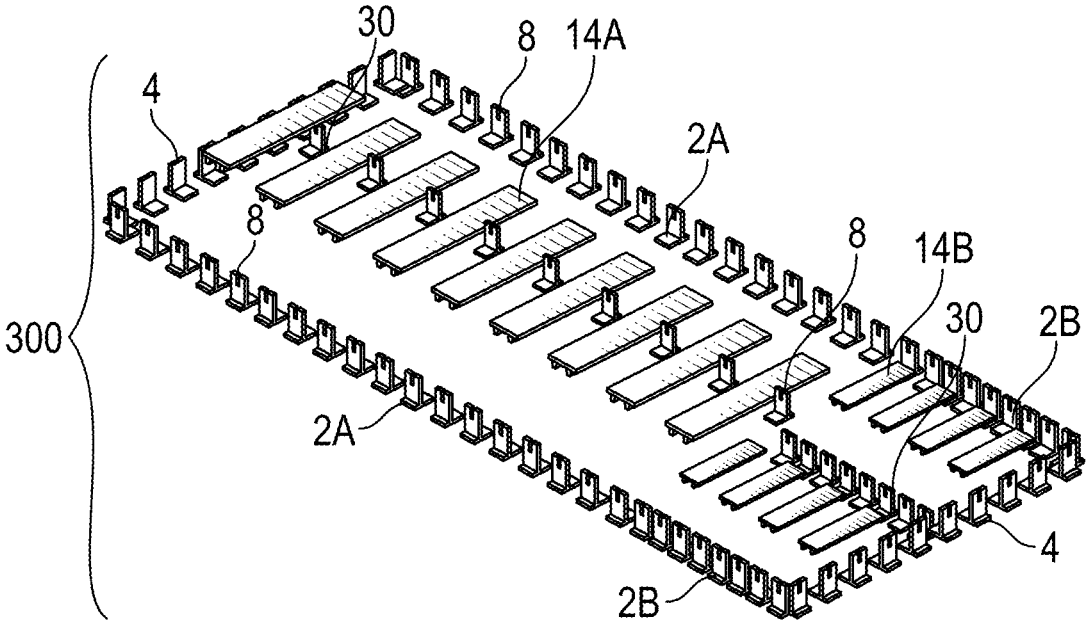
Figure 11A:
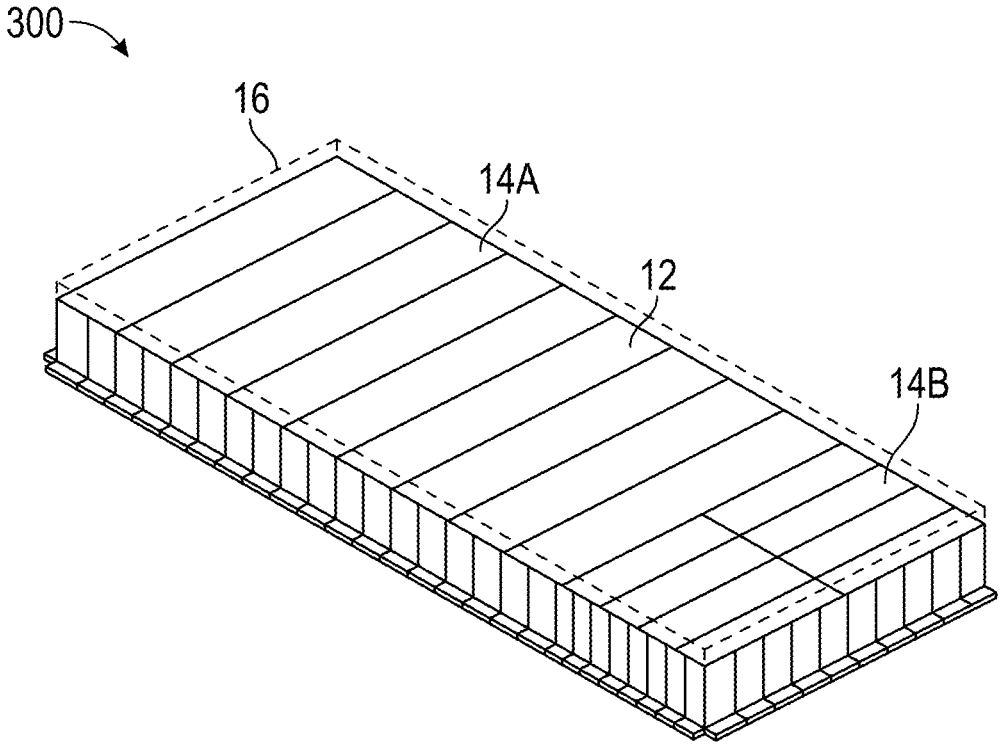
Figure 12:
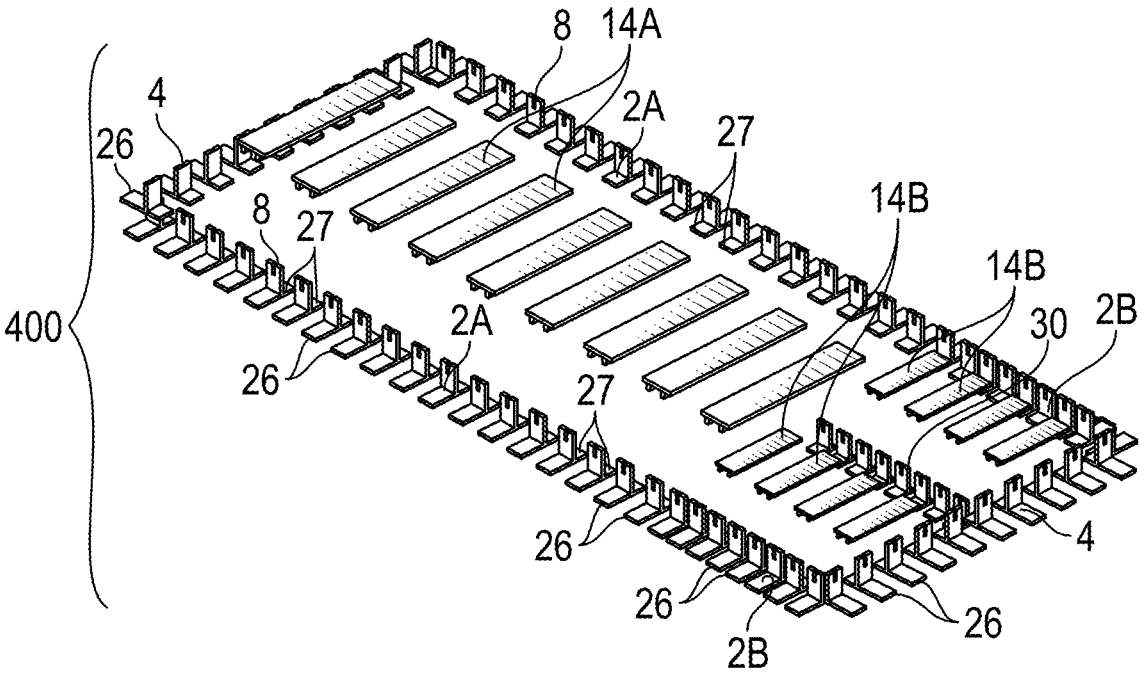
Figure 12A:
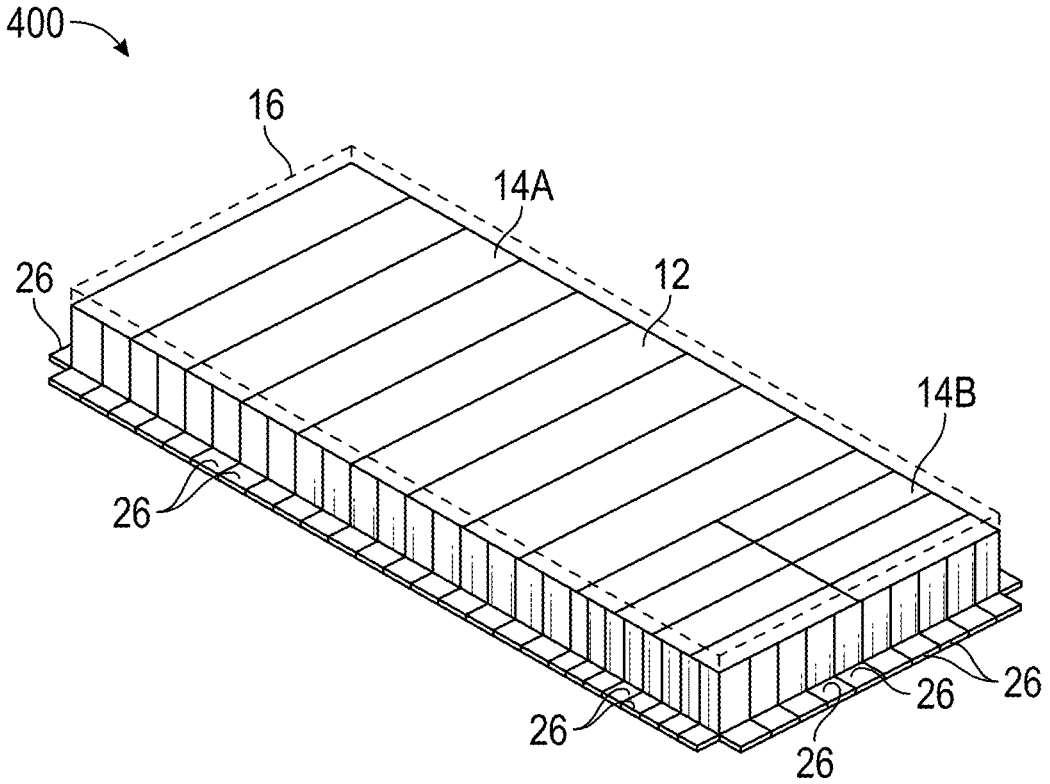
Figure 13:
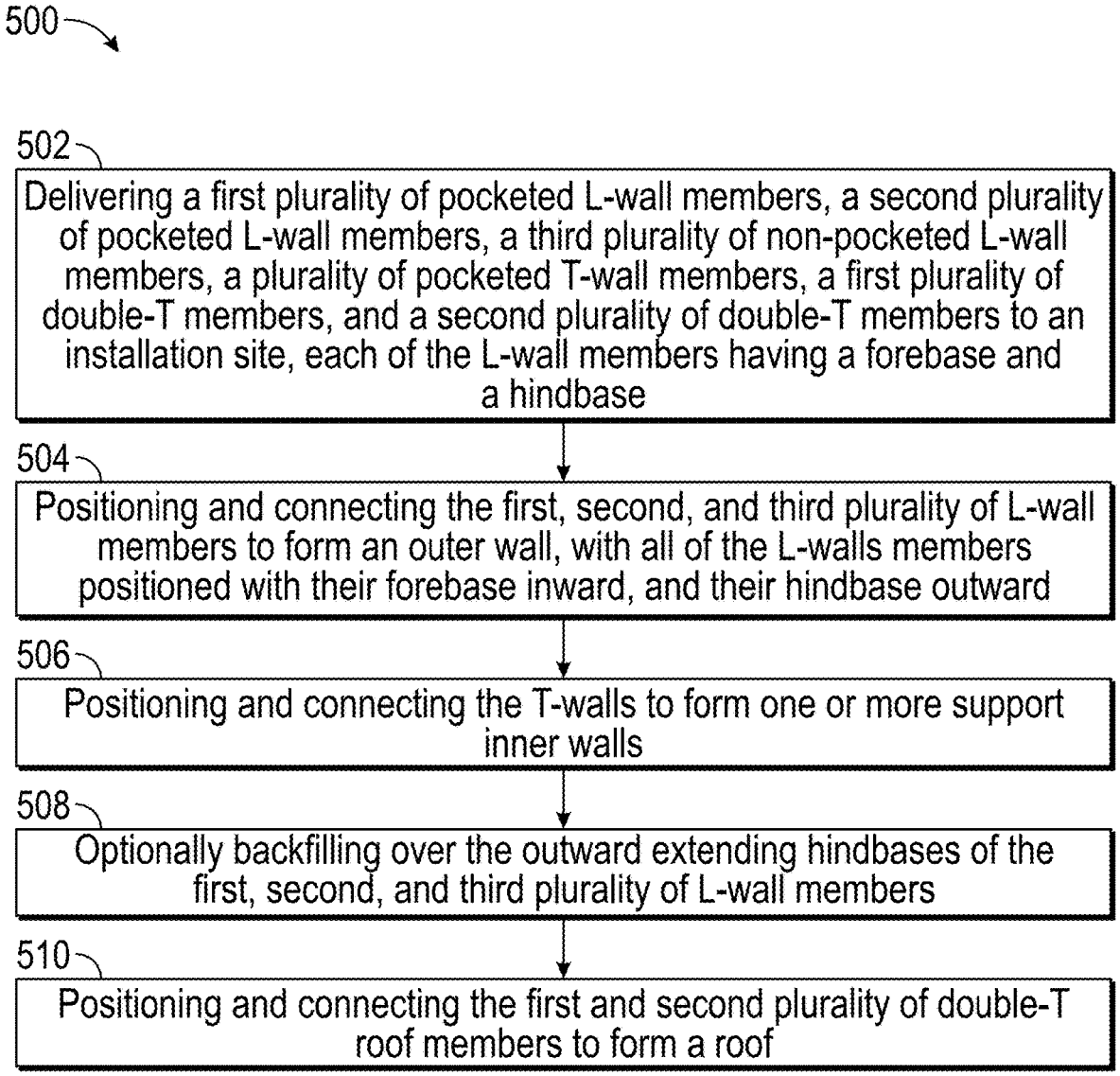
FIGS. 13, 14, 15, and 16 are logic diagrams of four non-limiting methods of installing the stormwater detention system embodiments illustrated in FIGS. 1A, 10A, 11A, and 12A in accordance with this disclosure.
Figure 14:
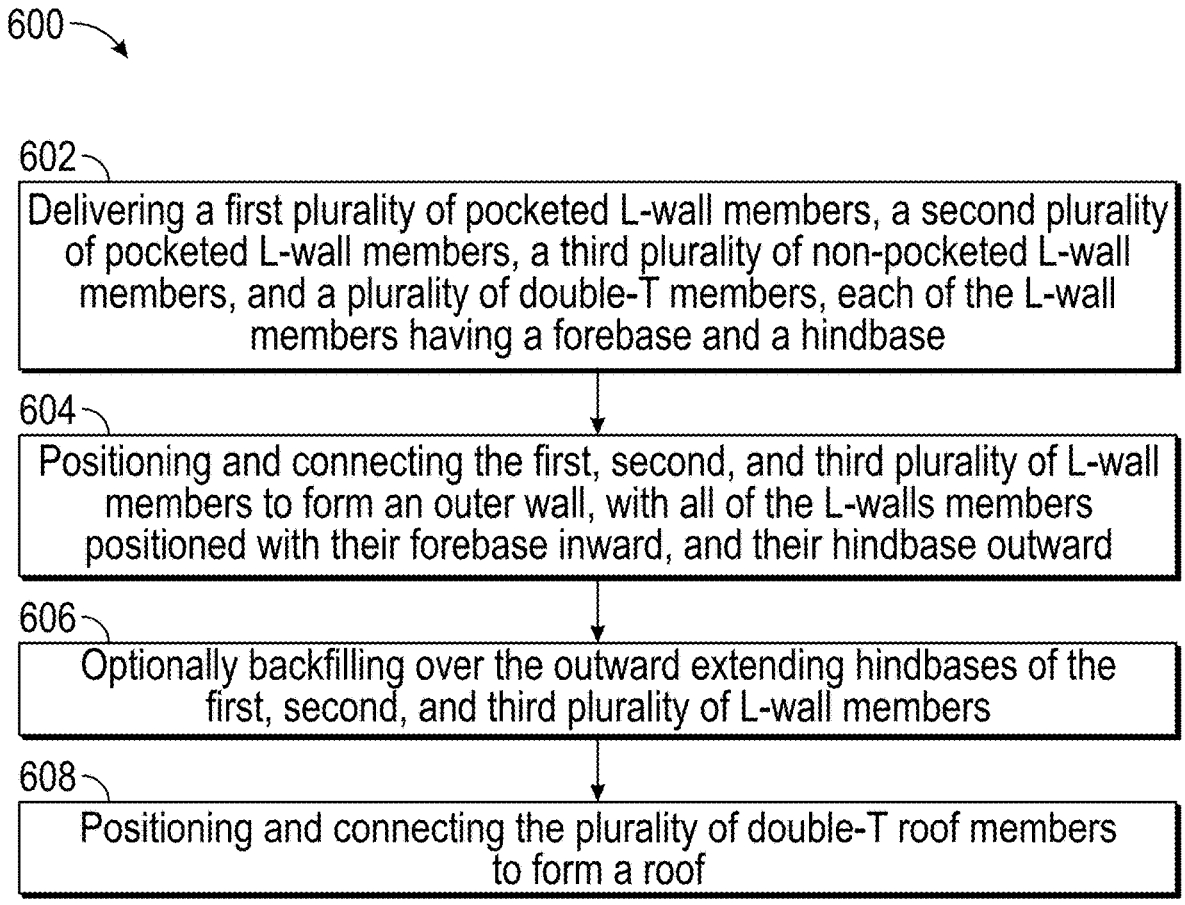
Figure 15:
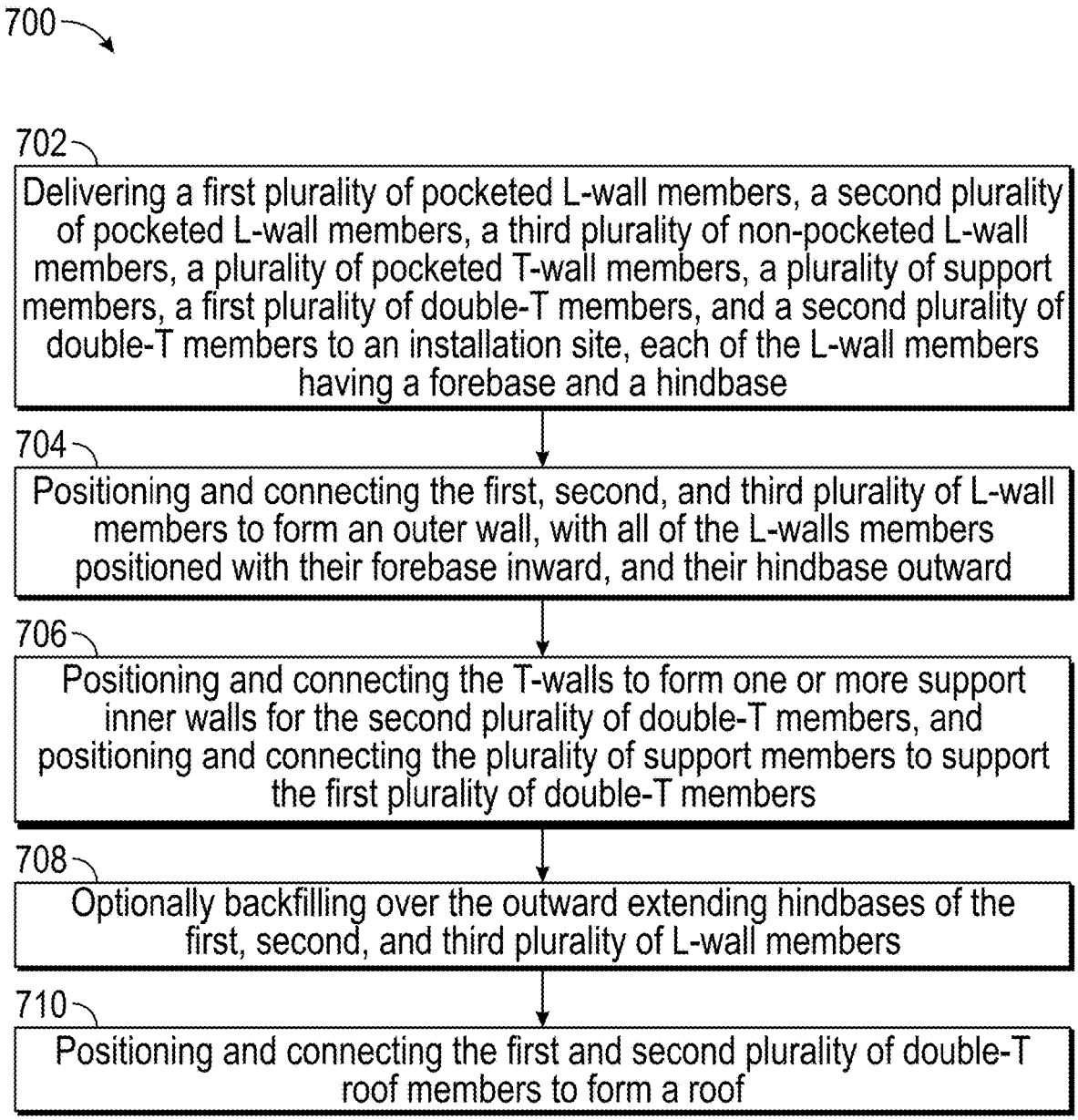
Figure 16:
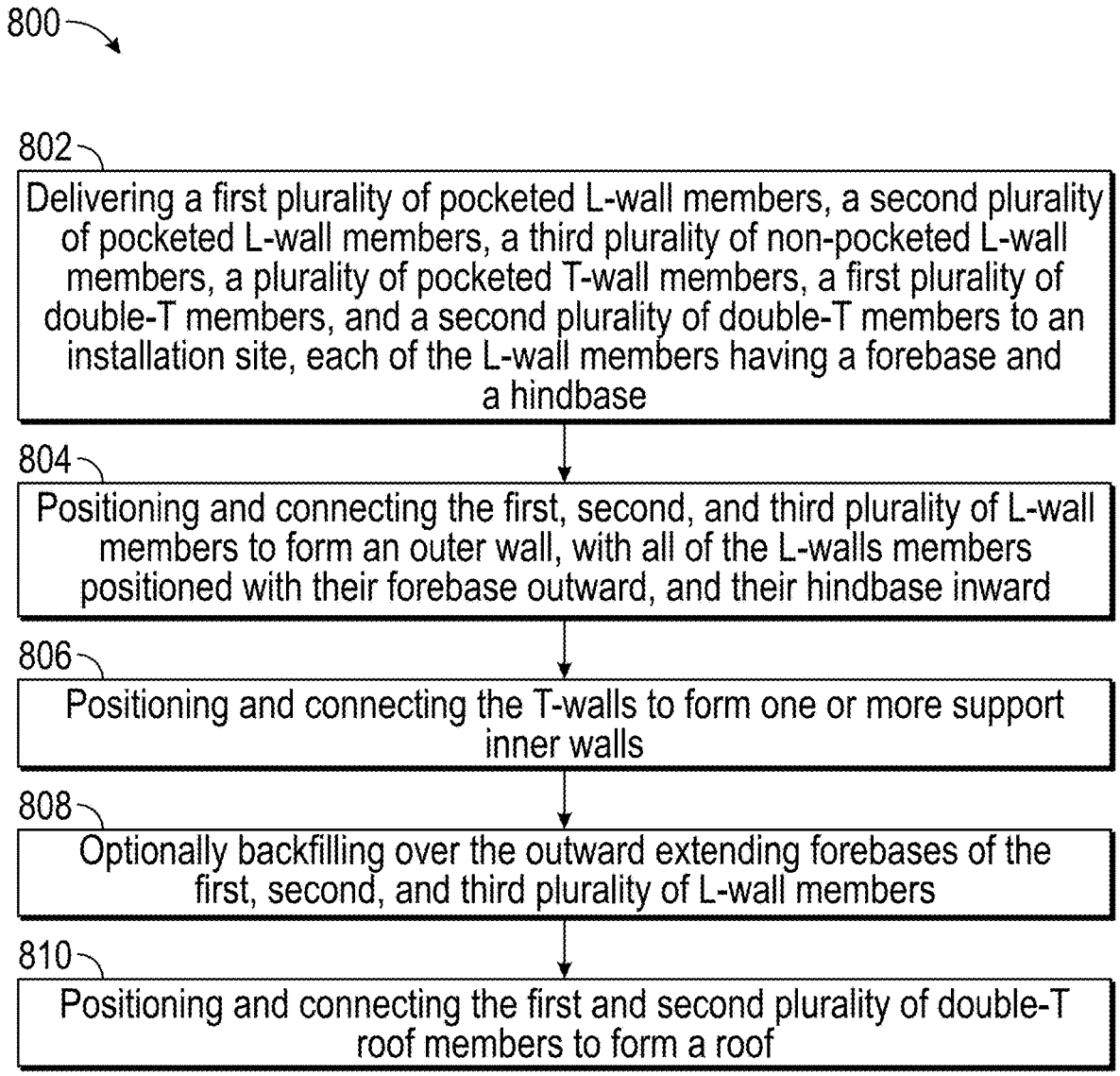

FIGS. 10, 11, and 12 are exploded schematic perspective illustrations, and FIGS. 10A, 11A, and 12A are schematic perspective illustrations of further embodiments of the present disclosure. Embodiment 200 is similar to embodiment 100 except the system is devoid of T-wall members, and devoid of a second plurality of double-T members. Embodiments like embodiment 200 may be employed when the detention system is to be used in a location where there will be no heavy traffic traversing over the structure, such as fire trucks, garbage trucks, and the like. Embodiment 300 is similar to embodiment 100 except the system includes further support members 30 under the double-T members 14A. In this embodiment the support members are pocketed T-members, but they may be L-wall members, columns, or some other support, and combinations of any of these. Further support members may be desired or required according to the size of the system. It should be noted that further support members may be included under double-T members 14B as well, or in lieu of those supporting double-T members 14A. Finally, embodiment 400 is similar to embodiment 100 except the system has the position of the L-wall members "reversed", in that the forebases face outward, while the hindbases face inward. Such a structure may provide more support (and/or more stormwater storage capacity) than embodiment 100 depending on soil conditions.

FIGS. 13, 14, 15, and 16 are logic diagrams of four non-limiting methods of installing the stormwater detention system embodiments illustrated in FIGS. 1A, 10A, 11A, and 12A in accordance with this disclosure. Method embodiment 500 includes the steps of a) delivering a first plurality of pocketed L-wall members, a second plurality of pocketed L-wall members, a third plurality of non-pocketed L-wall members, a plurality of pocketed T-wall members, a first plurality of double-T members, and a second plurality of double-T members to an installation site, each of the L-wall members having a forebase and a hindbase (box 502); b) positioning and connecting the first, second, and third pluralities of L-wall members to form an outer wall, with all of the L-wall members positioned with their forebases facing inward of the outer wall, and their hindbases facing outward of the outer wall (box 504); c) positioning and connecting the T-wall members to form one or more support inner walls (box 506); d) optionally backfilling over the outward extending hindbases of the first, second, and third pluralities of L-wall members (box 508); and e) positioning and connecting the first and second pluralities of double-T roof members to form a roof (box 510).

Method embodiment 600 includes the steps of a) delivering a first plurality of pocketed L-wall members, a second plurality of pocketed L-wall members, a third plurality of non-pocketed L-wall members, and a plurality of double-T members, each of the L-wall members having a forebase and a hindbase (box 602); b) positioning and connecting the first, second, and third pluralities of L-wall members to form the outer wall, with their forebases facing inward of the outer wall, and their hindbases facing outward of the outer wall (box 604); c) optionally backfilling over the outward extending hindbases of the first, second, and third pluralities of L-wall members (box 606); and d) positioning and connecting the plurality of double-T roof members to form a roof (box 608).

Method embodiment 700 includes the steps of a) delivering a first plurality of pocketed L-wall members, a second plurality of pocketed L-wall members, a third plurality of non-pocketed L-wall members, a plurality of pocketed T-wall members, a first plurality of double-T members, and a second plurality of double-T members to an installation site, each of the L-wall members having a forebase and a hindbase (box 702); b) positioning and connecting the first, second, and third pluralities of L-wall members to form an outer wall, with all of the L-wall members positioned with their forebases facing inward of the outer wall, and their hindbases facing outward of the outer wall (box 704); c) positioning and connecting the T-wall members to form one or more support inner walls, and positioning and connecting the plurality of support members to support the first plurality of double-T members (box 706); d) optionally backfilling over the outward extending hindbases of the first, second, and third pluralities of L-wall members (box 708); and e) positioning and connecting the first and second pluralities of double-T roof members to form a roof (box 710).

Method embodiment 800 includes the steps of a) delivering a first plurality of pocketed L-wall members, a second plurality of pocketed L-wall members, a third plurality of non-pocketed L-wall members, a plurality of pocketed T-wall members, a first plurality of double-T members, and a second plurality of double-T members to an installation site, each of the L-wall members having a forebase and a hindbase (box 802); b) positioning and connecting the first, second, and third pluralities of L-wall members to form an outer wall, with all of the L-wall members positioned with their forebases facing outward of the outer wall, and their hindbases facing inward of the outer wall (box 804); c) positioning and connecting the T-wall members to form one or more support inner walls (box 806); d) optionally backfilling over the outward extending hindbases of the first, second, and third pluralities of L-wall members (box 808); and e) positioning and connecting the first and second pluralities of double-T roof members to form a roof (box 810).

One or more pumps, in certain embodiments, may be powered for example using batteries, Li-ion or other type, or perhaps by a local generator, or grid power. A personal computer (PC) and graphical user interface (GUI) may allow an operator to interface with the stormwater detention system pumps, as well as any optional cameras, multipoint scanners, and the like. In certain embodiments the operator will be able to take stormwater detention measurements, view or read these measurements and reset the instrument for subsequent measurement taking. If the PC and GUI is connected to a power cable, then measurements may be taken remotely, stored and reset as necessary.

In certain embodiments the L-wall members, T-wall members, and/or double-T roof members may be comprised of a suitable material or materials to withstand environmental conditions expected in the geographic region of installation. Such materials may be inert to human-hazardous vapors or gases, such as hydrogen sulfide ($H_2S$). Suitable materials include various ceramic materials, such as concrete, metals and alloys, natural and man-made rubber compounds, elastomeric compounds, thermoplastic-elastomeric compounds, and the like, with or without fillers, additives, coupling agents, and other optional additives. L-wall members, T-wall members, and/or double-T roof members useful in the systems and methods of the present disclosure should have sufficient strength to withstand any mechanical stress (compression, tensile, shear) or other loads imposed by the items connected to them, and in the case of stormwater detention systems, stresses imposed by geologic faults in the region of installation and loads imposed by stormwater. This desire for sufficient strength is balanced by the need to maintain light-weight and balance. L-wall members, T-wall members, and double-T roof members should be capable of withstanding long term exposure to probable liquids and vapors, including hydrocarbons, solvents, brine, anti-freeze compositions, and the like, typically encountered in stormwater detention facilities. In certain embodiments, L-wall members, T-wall members, and double-T roof members may be corrosion-resistant, water-resistant, freeze-resistant, and heat-resistant. Such material properties may be supplied by one or more coatings.

In certain other embodiments, the stormwater detention system, L-wall members, T-wall members, and double-T roof members need not take the shapes as illustrated schematically in the drawings. For example, there are many versions of L-wall members, T-wall member, and double-T roof members commercially available. Furthermore, the stormwater detention system could take any shape, such as rectangular, elliptical, triangular, rectilinear, curvilinear, or combination thereof and the like, and may take on one or more levels, as long as the stormwater detention system is able to carry out its intended stormwater detention function. It will be understood that such embodiments are part of this disclosure and deemed with in the claims.

L-wall members, T-wall members, and double-T roof members and various components, such as corner members, and coatings for same, may be made using a variety of additive and/or subtractive processes, including molding, machining, and like subtractive processes, and/or subtractive processes such as net-shape casting (or near-net shape casting) using rapid prototype (RP) molds. Net-shape or near-net shape casting methods of making a variety of molds for producing a variety of complex products are summarized in patents assigned to 3D Systems, Inc., Rock Hill, S.C., U.S.A., for example U.S. Pat. No. 8,285,411. As summarized in the '411 patent, a number of technologies presently exist for the rapid creation of models, prototypes, and objects for limited run manufacturing. These technologies are generally called Solid Freeform Fabrication ("SFF") techniques. Some SFF techniques include stereolithography, selective deposition modeling, laminated object manufacturing, selective phase area deposition, multi-phase jet solidification, ballistic particle manufacturing, fused deposition modeling, particle deposition, laser sintering, film transfer imaging, and the like. Generally in SFF, complex parts are produced from a build material in an additive fashion as opposed to conventional fabrication techniques, which are generally subtractive in nature. For example, in most conventional subtractive fabrication techniques material is removed by machining operations or shaped in a die or mold to near net shape and then trimmed. In contrast, additive fabrication techniques incrementally add portions of a build material to targeted locations, layer by layer, in order to build a complex part. SFF technologies typically utilize a computer graphic representation of a part and a supply of a build material to fabricate the part in successive layers. According to the '411 patent, SFF technologies may dramatically shorten the time to develop prototype parts, can produce limited numbers of parts in rapid manufacturing methods, and may eliminate the need for complex tooling and machining associated with conventional subtractive manufacturing methods, including the need to create molds for custom applications. In addition, customized parts can be directly produced from computer graphic data (e.g., computer-aided design (CAD) files) in SFF techniques. Generally, in most techniques of SFF, structures are formed in a layer by layer manner by solidifying or curing successive layers of a build material. In selective laser sintering, a tightly focused beam of energy, such as a laser beam, is scanned across sequential layers of powder material to selectively sinter or melt powder (such as a metal or ceramic powder) in each layer to form a multilayered part. In selective deposition modeling, a build material is jetted or dropped in discrete droplets, or extruded through a nozzle, such that the build material becomes relatively rigid upon a change in temperature and/or exposure to actinic radiation in order to build up a three-dimensional part in a layerwise fashion. In another technique, film transfer imaging ("FTI"), a film transfers a thin coat of resin to an image plane area where portions of the resin corresponding to the cross-sectional layer of the part are selectively cured with actinic radiation to form one layer of a multilayer part. Certain SFF techniques require the part be suspended from a supporting surface such as a build pad, a platform, or the like using supports that join the part to the supporting surface. Prior art methods for generating supports are described in U.S. Pat. Nos. 5,595,703; 6,558,606; and 6,797,351. The Internet website of Quickparts.com, Inc., Atlanta, Ga., a subsidiary of 3D Systems Inc., has more information on some of these techniques and materials that may be used.

Figure 9A:
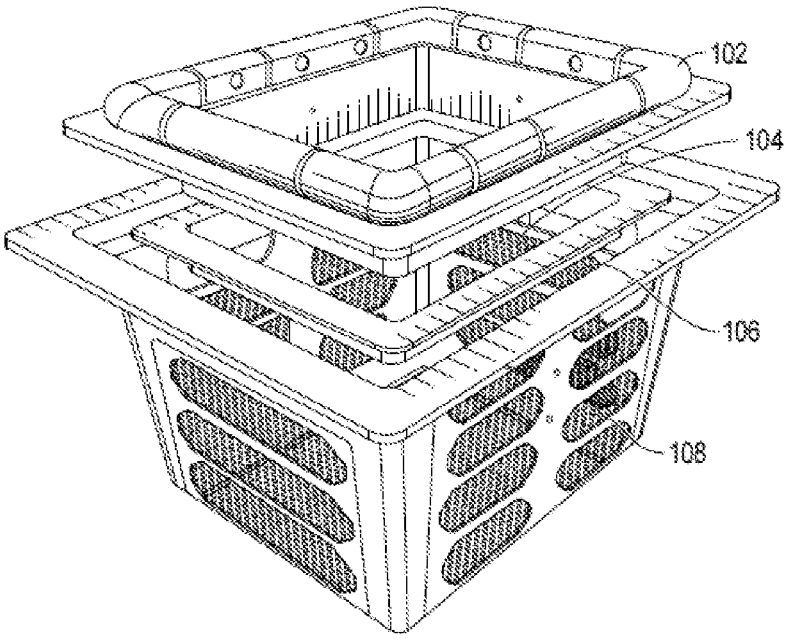
FIG. 9A (PRIOR ART)

Certain embodiments may include a precast inlet box and filter such as that known under the trade designation Grate Inlet Skimmer Box, or GISB, available from Suntree Technologies, Inc., Cocoa, Fla., USA. Such a precast inlet box and filter may be positioned to flow stormwater therethrough before it flows into an inlet on a double-T member, a L-wall member, or both of these options, and feature a specialized inlet filter specifically for use in grated catch basins. The unit is made of marine grade fiberglass and stainless steel to ensure longevity and durability. During a storm event, all incoming runoff passes through an internal skimmer tray and then optionally through and into contact with a hydrocarbon absorption media sock (known under the trade designation STORMBOOM, also available from Suntree Technologies, Inc.) used to remove chemicals and hydrocarbons from stormwater runoff. Stormwater and solid material then fall into the lower section of the skimmer box where small sieve sized filters capture and retain all solids. Turbulence deflectors within the filtration box act to calm the water and allow for a greater removal efficiency. Purified stormwater passes through the catch basin allowing the filtered materials to dry after each storm. After the storm event has subsided, the stormwater will drain from the filter box completely leaving all collected debris suspended in the screen system to dry until removed during routine service. The dry state storage contains the nutrient pollutant load while also working to prevent septic water, the breeding of mosquitoes and nutrient leaching. One embodiment of such a precast filter box is illustrated schematically in perspective exploded view in FIG. 9A, illustrating a boom 102, a coarse mesh screen 104, medium mesh screen 106, and fine mesh screen 108. Stormwater enters the inlet immediately coming in contact with a boom which absorbs floating hydrocarbons. The boom known under the trade designation STORMBOOM can be outfitted with multiple types of biosorption activated media and is installed around the top perimeter. Throughout the storm event, water continues to come in contact with the boom and then flows into the lower filtration chamber adjacent to the fine sieve size screens 108. The fine sieve size screens 108 filter out extra fine particulates such as phosphates and sand. As the storm intensity increases, the water level in the unit rises to a level adjacent with the medium size sieve screens 106 and turbulence deflector. The medium size sieve screens 106 provide additional flow with less chance of clogs or obstructions forming. The turbulence deflector reduces the turbidity in the lower chamber and prevents scouring. If the storm intensity becomes a high flow event, the water level in the unit rises further to a level adjacent to the coarse sieve size screens 104 above the turbulence deflector. The coarse screen 104 provides additional filtered flow with a far less chance of obstruction than the fine or medium sieve size screens and is designed to capture floating debris like foliage and trash. If the stormwater flow rate is extreme or the unit is full where the flow rate exceeds flow through all the screens, the water will bypass the screens by passing through skimmer protected openings at the top of the unit. After the storm event has subsided, the stormwater will drain from the unit completely leaving all collected debris suspended in the screen system to dry until removed during routine service. The dry state storage contains the nutrient pollutant load while also working to prevent septic water, the breeding of mosquitoes and nutrient leaching.

Thus systems and methods described herein provide a consistent, low-cost, and safe way of detaining stormwater employing one or more L-wall members, T-wall members, and double-T roof members without having to use multiple plastic conduits or specially shaped concrete elements. Some existing systems utilize many small precast elements. Others utilize galvanized piping chambers or plastic chambers. One common aspect of existing systems is that they have many pieces to install, the detention capacity is limited by the shapes and sizes of design limitations, and they are very expensive to manufacture, ship and install. Systems and methods of the present disclosure avoid some or all of these disadvantages of existing systems.

Embodiments disclosed herein include:

A and B: a system for stormwater detention comprising (or consisting essentially of, or consisting of):

an outer wall comprising a first plurality of L-wall members, a second plurality of L-wall members, and a third plurality of L-wall members arranged side by side and connected, the L-wall members each comprising a substantially vertical stem having a height h and a width w, and a base of width w connected to the stem and each having a forebase and a hindbase extending outward from the stem at a substantially horizontal angle, the forebase extending longer than the hindbase, at least a portion of the first and second plurality of L-wall member stems having a pocket extending a distance d from a top surface of the stem towards the base, where d<h, the pockets positioned substantially midway of the stem width, and the third plurality of L-wall member stems devoid of a pocket, the forebases facing inward of the outer wall and the hindbases facing outward of the outer wall;

a plurality of T-wall members arranged side by side and connected to form an inner support wall, the T-wall members each comprising a substantially vertical stem having a height h and a width w, and a base of width w connected to the stem and each having a forebase and a hindbase extending outward from the stem at a substantially horizontal angle, the forebase and the hindbase extending substantially equidistant from the stem, the stems of the plurality of T-wall members having a pocket extending a distance d from a top surface of the stem towards the base, where d<h, the pockets positioned substantially midway of the stem width;

optionally, one or more support members positioned under the first plurality of double-T members, the one or more support members selected from the group consisting of L-wall members, T-wall members, columns, and combinations thereof;

a roof comprising a first plurality of double-T roof members and a second plurality of double-T members, each having a span, a flange, and two webs, the webs having first and second ends engaged with one of the pockets of the stems of the first and second plurality of L-wall members; and at least one stormwater inlet and at least one stormwater outlet.

C: A system for stormwater detention comprising (or consisting essentially of, or consisting of):

an outer wall comprising a first plurality of L-wall members, a second plurality of L-wall members, and a third plurality of L-wall members arranged side by side and connected, the L-wall members each comprising a substantially vertical stem having a height h and a width w, and a base of width w connected to the stem and each having a forebase and a hindbase extending outward from the stem at a substantially horizontal angle, the forebase extending longer than the hindbase, at least a portion of the first and second plurality of L-wall member stems having a pocket extending a distance d from a top surface of the stem towards the base, where d<h, the pockets positioned substantially midway of the stem width, and the third plurality of L-wall member stems devoid of a pocket;

the system devoid of T-wall members arranged side by side and connected to form an inner support wall;

optionally, one or more support members positioned under the first plurality of double-T members, the one or more support members selected from the group consisting of L-wall members, T-wall members, columns, and combinations thereof;

a roof comprising a plurality of double-T roof members, each having a span, a flange, and two webs, the webs having first and second ends engaged with one of the pockets of the stems of the plurality of L-wall members; and at least one stormwater inlet and at least one stormwater outlet.

D: a system for stormwater detention comprising (or consisting essentially of, or consisting of):

an outer wall comprising a first plurality of L-wall members, a second plurality of L-wall members, and a third plurality of L-wall members arranged side by side and connected, the L-wall members each comprising a substantially vertical stem having a height h and a width w, and a base of width w connected to the stem and each having a forebase and a hindbase extending outward from the stem at a substantially horizontal angle, the forebase extending longer than the hindbase, at least a portion of the first and second plurality of L-wall member stems having a pocket extending a distance d from a top surface of the stem towards the base, where d<h, the pockets positioned substantially midway of the stem width, and the third plurality of L-wall member stems devoid of a pocket, the forebases facing outward of the outer wall and the hindbases facing inward of the outer wall;

a plurality of T-wall members arranged side by side and connected to form an inner support wall, the T-wall members each comprising a substantially vertical stem having a height h and a width w, and a base of width w connected to the stem and each having a forebase and a hindbase extending outward from the stem at a substantially horizontal angle, the forebase and the hindbase extending substantially equidistant from the stem, the stems of the plurality of T-wall members having a pocket extending a distance d from a top surface of the stem towards the base, where d<h, the pockets positioned substantially midway of the stem width;

optionally, one or more support members positioned under the first plurality of double-T members, the one or more support members selected from the group consisting of L-wall members, T-wall members, columns, and combinations thereof;

a roof comprising a first plurality of double-T roof members and a second plurality of double-T members, each having a span, a flange, and two webs, the webs having first and second ends engaged with one of the pockets of the stems of the first and second plurality of L-wall members; and at least one stormwater inlet and at least one stormwater outlet.

E: a method for installing a stormwater detention system, the method comprising (or consisting essentially of, or consisting of):

a) delivering a first plurality of pocketed L-wall members, a second plurality of pocketed L-wall members, a third plurality of non-pocketed L-wall members, a plurality of pocketed T-wall members, a first plurality of double-T members, and a second plurality of double-T members to an installation site, each of the L-wall members having a forebase and a hindbase;

b) positioning and connecting the first, second, and third pluralities of L-wall members to form an outer wall, with all of the L-wall members positioned with their forebases facing inward of the outer wall, and their hindbases facing outward of the outer wall;

c) positioning and connecting the T-wall members to form one or more support inner walls;

d) optionally backfilling over the outward extending hindbases of the first, second, and third pluralities of L-wall members; and e) positioning and connecting the first and second pluralities of double-T roof members to form a roof.

F: a method for installing a stormwater detention system, the method comprising (or consisting essentially of, or consisting of):

a) delivering a first plurality of pocketed L-wall members, a second plurality of pocketed L-wall members, a third plurality of non-pocketed L-wall members, and a plurality of double-T members, each of the L-wall members having a forebase and a hindbase;

b) positioning and connecting the first, second, and third pluralities of L-wall members to form the outer wall, with their forebases facing inward of the outer wall, and their hindbases facing outward of the outer wall;

c) optionally backfilling over the outward extending hindbases of the first, second, and third pluralities of L-wall members; and d) positioning and connecting the plurality of double-T roof members to form a roof.

G: a method for installing a stormwater detention system, the method comprising (or consisting essentially of, or consisting of):

a) delivering a first plurality of pocketed L-wall members, a second plurality of pocketed L-wall members, a third plurality of non-pocketed L-wall members, a plurality of pocketed T-wall members, a first plurality of double-T members, and a second plurality of double-T members to an installation site, each of the L-wall members having a forebase and a hindbase;

b) positioning and connecting the first, second, and third pluralities of L-wall members to form an outer wall, with all of the L-wall members positioned with their forebases facing inward of the outer wall, and their hindbases facing outward of the outer wall;

c) positioning and connecting the T-wall members to form one or more support inner walls, and positioning and connecting the plurality of support members to support the first plurality of double-T members;

d) optionally backfilling over the outward extending hindbases of the first, second, and third pluralities of L-wall members; and e) positioning and connecting the first and second pluralities of double-T roof members to form a roof.

H: a method for installing a stormwater detention system, the method comprising (or consisting essentially of, or consisting of):

a) delivering a first plurality of pocketed L-wall members, a second plurality of pocketed L-wall members, a third plurality of non-pocketed L-wall members, a plurality of pocketed T-wall members, a first plurality of double-T members, and a second plurality of double-T members to an installation site, each of the L-wall members having a forebase and a hindbase;

b) positioning and connecting the first, second, and third pluralities of L-wall members to form an outer wall, with all of the L-wall members positioned with their forebases facing outward of the outer wall, and their hindbases facing inward of the outer wall;

c) positioning and connecting the T-wall members to form one or more support inner walls;

d) optionally backfilling over the outward extending hindbases of the first, second, and third pluralities of L-wall members; and e) positioning and connecting the first and second pluralities of double-T roof members to form a roof.

Each of the embodiments A, B, C, E, G, and H may have one of more of the following additional elements in any combination:

Element 1: the stormwater detention system may be configurable wherein the outer wall comprising a plurality of L-wall members comprises a plurality of precast cantilever L-wall members with the base of each L-wall member positioned under reinforced backfill mass.

Element 2: the plurality of L-wall members and double-T roof members comprise precast and prestress concrete elements.

Element 3: an L-wall member is configured with a camera to provide live visual inspection feed to the one or more user interfaces remote from system.

Element 4: systems comprising one or more manways for accessing an interior space of the system.

Element 5: systems comprising a concrete floor.

Element 6: systems comprising at least one outlet conduit.

Element 7: systems comprising one or more inlet filters and/or one or more pumps for pumping water out of the system.

Element 8: systems devoid of T-walls.

Element 9: systems devoid of a second plurality of double-T members;

Element 10: The stormwater detention system pumps may be operated locally via an on-board motor operated by batteries, solar power, permanent or leased generator, optionally with a programmable logic controller and stormwater level feedback controller.

Element 11: providing live visual inspection feed images to one or more user interfaces remote from the stormwater detention site employing one or more cameras mounted to L-wall members, T-wall members, and/or double T roof members.

Element 12: Methods where one or more pumps are delivered and installed.

Element 13: Systems and methods using large span roof members comprised of prestressed concrete members supported by load bearing retaining walls and optional support structures.

Element 14: Systems including a precast cantilever L-Wall with the wall foundation under the reinforced backfill mass, covered by a prestressed concrete "double tee" roof.

Element 15: Systems and methods may utilize 6480 square feet to deliver 77,750 cubic feet of storage.

Element 16: Systems and methods utilizing the roof as a parking structure instead of a traditional concrete parking lot above a detention system currently in the marketplace that requires select backfill, stabilizing the sub base and pouring a thicker paving depth for the parking lot.

Element 17: systems and methods including one or more heavy duty industrial grade top mounted trash pumps to drain the detention structure after a rain event. This feature greatly improves the efficiency of systems and methods of the present disclosure to allow design of deeper and higher volume structures with a smaller footprint.

Element 18: systems and methods that are a hybrid option where a natural exit flow design drains the upper section of the detention structure down to the natural flow line by gravity flow and one or more pumps drains the area below the natural flow line.

Element 19: systems including backup generators in the event public power is lost.

From the foregoing detailed description of specific embodiments, it should be apparent that patentable systems and methods have been described. Although specific embodiments of the disclosure have been described herein in some detail, this has been done solely for the purposes of describing various features and aspects of the systems and methods and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, one modification would be to take an existing stormwater detention system and modify it to remove existing features and install features described herein in accordance with the present disclosure. Another modification would be for T-wall member suppliers, L-wall member suppliers, and/or double-T roof member suppliers to supply these members with coatings or topping materials, for example suitable for parking lots. In other embodiments, the T-wall members, L-wall members, and/or double-T roof members may be mountable on trucks or other vehicles drivable by humans, or on self-driving trucks or autos.

What is claimed is:

1. A system for stormwater detention, the system comprising:

an outer wall comprising a first plurality of L-wall members, a second plurality of L-wall members, and a third plurality of L-wall members arranged side by side and connected, the L-wall members each comprising a substantially vertical stem having a height h and a width w, and a base of width w connected to the stem and each having a forebase and a hindbase extending outward from the stem at a substantially horizontal angle, the forebase extending longer than the hindbase, at least a portion of the first and second plurality of L-wall member stems having a pocket extending a distance d from a top surface of the stem towards the base, where d<h, the pockets positioned substantially midway of the stem width, and the third plurality of L-wall member stems devoid of a pocket, the forebases facing inward of the outer wall and the hindbases facing outward of the outer wall;

a plurality of T-wall members arranged side by side and connected to form an inner support wall, the T-wall members each comprising a substantially vertical stem having a height h and a width w, and a base of width w connected to the stem and each having a forebase and a hindbase extending outward from the stem at a substantially horizontal angle, the forebase and the hindbase extending substantially equidistant from the stem, the stems of the plurality of T-wall members having a pocket extending a distance d from a top surface of the stem towards the base, where d<h, the pockets positioned substantially midway of the stem width;

a roof comprising a first plurality of double-T roof members and a second plurality of double-T members, each having a span, a flange, and two webs, the webs having first and second ends engaged with one of the pockets of the stems of the first and second plurality of L-wall members; and at least one stormwater inlet and at least one stormwater outlet.

2. The system of claim 1 wherein the first, second, and third pluralities of L-wall members comprise a plurality of precast cantilever L-wall members with at least the hindbases of each L-wall member positioned under reinforced backfill mass.

3. The system of claim 1 wherein each of the plurality of L-wall members, T-wall members, and double-T roof members comprise precast and prestress concrete elements.

4. The system of claim 1 devoid of one or more support members.

5. The system of claim 1 wherein one or more of the L-wall members is configured with a camera to provide live visual inspection feed to one or more user interfaces remote from the L-wall members.

6. The system of claim 1 comprising one or more manways for accessing an interior space of the system.

7. The system of claim 1 comprising a concrete floor.

8. The system of claim 7 comprising at least one outlet conduit in the concrete floor.

9. The system of claim 1 comprising one or more stormwater inlet filters and/or one or more pumps for pumping stormwater out of the system.

10. A system for stormwater detention, the system comprising:

an outer wall comprising a first plurality of L-wall members, a second plurality of L-wall members, and a third plurality of L-wall members arranged side by side and connected, the L-wall members each comprising a substantially vertical stem having a height h and a width w, and a base of width w connected to the stem and each having a forebase and a hindbase extending outward from the stem at a substantially horizontal angle, the forebase extending longer than the hindbase, at least a portion of the first and second plurality of L-wall member stems having a pocket extending a distance d from a top surface of the stem towards the base, where d<h, the pockets positioned substantially midway of the stem width, and the third plurality of L-wall member stems devoid of a pocket;

the system devoid of T-wall members arranged side by side and connected to form an inner support wall;

a roof comprising a plurality of double-T roof members, each having a span, a flange, and two webs, the webs having first and second ends engaged with one of the pockets of the stems of the plurality of L-wall members; and at least one stormwater inlet and at least one stormwater outlet.

11. The system of claim 10 wherein the first, second, and third pluralities of L-wall members comprise a plurality of precast cantilever L-wall members with at least the hindbases of each L-wall member positioned under reinforced backfill mass.

12. The system of claim 10 wherein each of the plurality of L-wall members and double-T roof members comprise precast and prestress concrete elements.

13. The system of claim 10 devoid of the one or more support members.

14. The system of claim 10 wherein at least one of the L-wall members is configured with a camera to provide live visual inspection feed to the one or more user interfaces remote from the L-wall members.

15. The system of claim 10 comprising one or more manways for accessing an interior space of the system.

16. The system of claim 10 comprising a concrete floor.

17. The system of claim 16 comprising at least one outlet conduit.

18. The system of claim 10 comprising one or more stormwater inlet filters and/or one or more pumps for pumping stormwater out of the system.

19. A system for stormwater detention, the system defining a stormwater detention volume, the system comprising:

an outer wall comprising a first plurality of L-wall members, a second plurality of L-wall members, and a third plurality of L-wall members arranged side by side and connected, the L-wall members each comprising a substantially vertical stem having a height h and a width w, and a base of width w connected to the stem and each having a forebase and a hindbase extending outward from the stem at a substantially horizontal angle, the forebase extending longer than the hindbase, at least a portion of the first and second plurality of L-wall member stems having a pocket extending a distance d from a top surface of the stem towards the base, where d<h, the pockets positioned substantially midway of the stem width, and the third plurality of L-wall member stems devoid of a pocket, the forebases facing outward of the outer wall and the hindbases facing inward of the outer wall;

a plurality of T-wall members arranged side by side and connected to form an inner support wall, the T-wall members each comprising a substantially vertical stem having a height h and a width w, and a base of width w connected to the stem and each having a forebase and a hindbase extending outward from the stem at a substantially horizontal angle, the forebase and the hindbase extending substantially equidistant from the stem, the stems of the plurality of T-wall members having a pocket extending a distance d from a top surface of the stem towards the base, where d<h, the pockets positioned substantially midway of the stem width;

a roof comprising a first plurality of double-T roof members and a second plurality of double-T members, each having a span, a flange, and two webs, the webs having first and second ends engaged with one of the pockets of the stems of the first and second plurality of L-wall members; and at least one stormwater inlet and at least one stormwater outlet.

20. The system of claim 19 wherein the first, second, and third pluralities of L-wall members comprise a plurality of precast cantilever L-wall members with at least the forebases of each L-wall member positioned under reinforced backfill mass.

21. The system of claim 19 wherein each of the first plurality of T-wall members, each of the first plurality of L-wall members, and each of the double-T roof members comprise precast and prestress concrete elements.

22. The system of claim 19 devoid of the one or more support members.

23. The system of claim 19 wherein at least one of the plurality of T-wall members, the first, second, and third plurality of L-wall members, and the double-T roof members is configured with a camera to provide live visual inspection feed to one or more user interfaces remote from the system.

24. The system of claim 19 comprising one or more manways for accessing an interior space of the system.

25. The system of claim 19 comprising a concrete floor.

26. The system of claim 25 comprising at least one outlet conduit.

27. The system of claim 26 comprising one or more stormwater inlet filters and/or one or more pumps for pumping stormwater out of the system.

28. A method of installing a stormwater detention system of claim 1, the method comprising:

a) delivering a first plurality of pocketed L-wall members, a second plurality of pocketed L-wall members, a third plurality of non-pocketed L-wall members, a plurality of pocketed T-wall members, a first plurality of double-T members, and a second plurality of double-T members to an installation site, each of the L-wall members having a forebase and a hindbase;

b) positioning and connecting the first, second, and third pluralities of L-wall members to form an outer wall, with all of the L-wall members positioned with their forebases facing inward of the outer wall, and their hindbases facing outward of the outer wall;

c) positioning and connecting the T-wall members to form one or more support inner walls; and d) positioning and connecting the first plurality of T-wall members and the second plurality of double-T roof members to form a roof.

29. A method of installing a stormwater detention system of claim 10, the method comprising:

a) delivering a first plurality of pocketed L-wall members, a second plurality of pocketed L-wall members, a third plurality of non-pocketed L-wall members, and a plurality of double-T members, each of the L-wall members having a forebase and a hindbase;

b) positioning and connecting the first, second, and third pluralities of L-wall members to form the outer wall, with their forebases facing inward of the outer wall, and their hindbases facing outward of the outer wall; and c) positioning and connecting the plurality of double T roof members to form a roof.

30. A method of installing a stormwater detention system of claim 1, the method comprising:

a) delivering a first plurality of pocketed L-wall members, a second plurality of pocketed L-wall members, a third plurality of non-pocketed L-wall members, a plurality of pocketed T-wall members, a first plurality of double-T members, and a second plurality of double-T members to an installation site, each of the L-wall members having a forebase and a hindbase;

b) positioning and connecting the first, second, and third pluralities of L-wall members to form an outer wall, with all of the L-wall members positioned with their forebases facing inward of the outer wall, and their hindbases facing outward of the outer wall;

c) positioning and connecting the T-wall members to form one or more support inner walls, and positioning and connecting the plurality of support members to support the first plurality of double-T members; and d) positioning and connecting the first plurality of T-wall members and the second plurality of double-T roof members to form a roof.

31. A method of installing a stormwater detention system of claim 19, the method comprising:

a) delivering a first plurality of pocketed L-wall members, a second plurality of pocketed L-wall members, a third plurality of non-pocketed L-wall members, a plurality of pocketed T-wall members, a first plurality of double-T members, and a second plurality of double-T members to an installation site, each of the L-wall members having a forebase and a hindbase;

b) positioning and connecting the first, second, and third pluralities of L-wall members to form an outer wall, with all of the L-wall members positioned with their forebases facing outward of the outer wall, and their hindbases facing inward of the outer wall;

c) positioning and connecting the T-wall members to form one or more support inner walls; and d) positioning and connecting the first plurality of T-wall members and the second plurality of double-T roof members to form a roof.

* * * * *